US008655210B2

(12) United States Patent
Fujita

(10) Patent No.: US 8,655,210 B2
(45) Date of Patent: Feb. 18, 2014

(54) IMAGE FORMING APPARATUS WITH POTENTIAL DIFFERENCE CONTROL

(75) Inventor: Hideki Fujita, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 12/652,854

(22) Filed: Jan. 6, 2010

(65) Prior Publication Data

US 2010/0183324 A1 Jul. 22, 2010

(30) Foreign Application Priority Data

Jan. 22, 2009 (JP) ..... 2009-011892

(51) Int. Cl.
*G03G 15/06* (2006.01)

(52) U.S. Cl.
USPC ..... 399/55; 399/45

(58) Field of Classification Search
USPC ..... 399/45, 55
See application file for complete search history.

(56) References Cited

U.S. PATENT DOCUMENTS

| | | | | |
|---|---|---|---|---|
| 5,504,272 | A * | 4/1996 | Uchiyama et al. | 399/277 |
| 5,697,010 | A | 12/1997 | Masuda et al. | |
| 6,282,393 | B1 | 8/2001 | Fujita | |
| 6,801,727 | B2 * | 10/2004 | Maruyama et al. | 399/45 |
| 7,343,111 | B2 | 3/2008 | Itagaki | |
| 7,751,733 | B2 | 7/2010 | Sako et al. | |
| 2006/0045551 | A1 | 3/2006 | Itagaki | |
| 2007/0110463 | A1 * | 5/2007 | Sako et al. | 399/45 |
| 2008/0144059 | A1 | 6/2008 | Nagai | |
| 2009/0016756 | A1 * | 1/2009 | Bessho | 399/56 |

FOREIGN PATENT DOCUMENTS

| | | | |
|---|---|---|---|
| JP | 9-323448 | A | 12/1997 |
| JP | 2000-175029 | A | 6/2000 |
| JP | 2001-80112 | A | 3/2001 |
| JP | 2001-201985 | A | 7/2001 |
| JP | 2002-214943 | A | 7/2002 |
| JP | 2003-162182 | A | 6/2003 |
| JP | 2005-165114 | A | 6/2005 |
| JP | 2006-71990 | A | 3/2006 |
| JP | 2006-126245 | A | 5/2006 |
| JP | 2006-295624 | A | 10/2006 |
| JP | 2007-34234 | | 2/2007 |
| JP | 2007-133309 | A | 5/2007 |
| JP | 2008-151878 | A | 7/2008 |
| JP | 2009-290612 | A | 12/2009 |

OTHER PUBLICATIONS

Notification of Reasons for Refusal issued Dec. 18, 2012, in Japanese Application No. 2009-011892.

* cited by examiner

*Primary Examiner* — G. M. Hyder
(74) *Attorney, Agent, or Firm* — Fitzpatrick, Cella, Harper & Scinto

(57) ABSTRACT

The image forming apparatus includes a photosensitive drum, developer bearing members to develop a latent image formed on the photosensitive drum into a toner image while bearing developer, a secondary transfer roller to transfer the toner image to a sheet, an operation apparatus to which smoothness of the sheet having the toner image transferred, and a CPU which controls to decrease fog elimination potential difference between non-image portion potential of the photosensitive drum and direct current component potential of bias applied to developer bearing members in a case that smoothness inputted to the operation apparatus is information that the smoothness of the sheet having the toner image formed is equal to or higher than a predetermined smoothness as compared to a case of being lower than the predetermined smoothness.

7 Claims, 25 Drawing Sheets

FIG. 11

| | | IMAGE FORMING CONDITIONS OF SPECIFIC SHEET | | | | SHEET TYPE DISCRIMINATION |
|---|---|---|---|---|---|---|
| | | Vb (V) | Vpp (kV) | THINNING | OTHERS | |
| EMBODIMENTS | 1 | REDUCTION | SAME AS NORMAL | SAME AS NORMAL | | MANUAL |
| | 2 | REDUCTION | REDUCTION | SAME AS NORMAL | | MANUAL |
| | 3 | REDUCTION | REDUCTION | YES | | MANUAL |
| | 4 | REDUCTION | REDUCTION | YES | | AUTOMATIC |
| | | | | | | |
| COMPARISON EXAMPLES | 1 | SAME AS NORMAL | SAME AS NORMAL | SAME AS NORMAL | | MANUAL |
| | 2 | SAME AS NORMAL | SAME AS NORMAL | SAME AS NORMAL | | NO |
| | 3 | SAME AS NORMAL | SAME AS NORMAL | SAME AS NORMAL | TRANSFER MEMBER CONTACT PRESSURE REDUCTION | MANUAL |

FIG. 12

| | | BOOKLET MODE*1, PRODUCTIVITY (COPIES PER HOUR) | ON SPECIFIC SHEET AFTER PERFORMING 1000 COPIES OF BOOKLETS IN BOOKLET MODE | | | |
|---|---|---|---|---|---|---|
| | | | SHADOWING | REVERSAL FOG | OTHER IMAGE FAILURE | LINE WIDTH |
| EMBODIMENTS | 1 | 46.8 | ○ | ○ | SLIGHT TAILING AND EXPLOSION | SLIGHTLY THICK |
| | 2 | 46.8 | ○ | ○ | SLIGHT ORDINARY FOG | APPROPRIATE |
| | 3 | 46.8 | ○ | ○ | ○ | APPROPRIATE |
| | 4 | 46.8 | ○ | ○ | ○ | APPROPRIATE |
| | | | | | | |
| COMPARISON EXAMPLES | 1 | 46.8 | × | × | FOG | APPROPRIATE |
| | 2 | 46.8 | × | × | FOG | APPROPRIATE |
| | 3 | 18.7 | × | × | FOG | APPROPRIATE |

IMAGE FORMING APPARATUS WITH POTENTIAL DIFFERENCE CONTROL

BACKGROUND OF THE INVENTION

1. Field of the Invention

The present invention relates to an image forming apparatus of an electrophotographic system such as a printer, a copying machine and a facsimile machine to form an image on a sheet (i.e., paper or clear film on which a toner image is formed) with toner.

2. Description of Related Art

FIG. 21 is a distribution graph of electric charges of toner used for an image forming apparatus of an electrophotographic system. As illustrated in FIG. 21, for example, in the case that charge polarity of the toner for forming a toner image is negative, there exists reversal charge toner charged positive within the toner while a large amount of ordinary charge toner charged negative is in the toner.

FIG. 22 is a sectional view which illustrates the configuration of a development device 4. As illustrated in FIG. 22, the toner is often charged due to friction with a developer bearing member 41 of the development device 4. When friction is generated at the toner due to the rotation of the developer bearing member 41, the ordinary charge toner and the reversal charge toner are generated at a specific probability and they are newly generated in the toner when new toner is supplied.

As illustrated in FIG. 22, the development device 4 has a development container 40. A developer amount restriction member 43 is arranged at an opening of the development container 40. A developer bearing member 41 is arranged at the opening surrounded by the development container 40 and the developer amount restriction member 43. One half of the developer bearing member 41 is arranged inside the development container 40 and the other half is arranged outside the development container 40. A magnet 42 is arranged as "magnetic field generation unit" inside the developer bearing member 41. A development bias supply 47 is connected to the developer bearing member 41. The developer bearing member 41 is arranged to be opposite to a photosensitive drum 1.

FIG. 23 is a plane view which illustrates the occurrence of shadowing at the surface of a sheet m. As illustrated in FIG. 23, when the sheet m is moved in the proceeding direction A, the reversal charge toner charged positive is accumulated inside the development device 4. This may lead to the occurrence of imaging failure called shadowing having patterns like a shadow at the front side of the image formed on the sheet m.

FIG. 24 is a graph which illustrates the relation between fog (%) and sheet smoothness (s). There is a case that the abovementioned reversal charge toner causes reversal fog at white parts of the image. It is known that the shadowing gets worse when the reversal fog gets worse. With high sheet smoothness, both the reversal fog and the shadowing are to worsen. This is because, in the case of using a high smoothness sheet (i.e., coated paper having especially high smoothness), closeness of the sheet and the photosensitive drum is enhanced and clearance to avoid the toner from being pressed to the sheet is eliminated. It is considered that the toner is transferred to the sheet in the abovementioned state by pressure due to enhanced tightness between the sheet and the image bearing member.

FIG. 25 is a graph which illustrates the relation between the fog and fog elimination potential difference. Direct current component potential Vdevdc of bias applied to the developer bearing member in the development device is measured while non-image portion potential Vni of the photosensitive drum is measured. The fog elimination potential difference Vb is expressed by an absolute value of potential difference between the non-image portion potential Vni of the photosensitive drum and the direct current component potential Vdevdc of the development bias (see FIG. 3). As illustrated in FIG. 25, the fog is set at the minimum value when the fog elimination potential difference Vb is 150 V. Ordinary fog and reversal fog are included in the fog. Ordinary fog is defined as the fog caused by the toner expected to form an image. Reversal fog is defined as the fog caused by the toner having the opposite charge polarity to the charge polarity of the toner forming an image. The majority of the charge polarity of the toner when charged by friction is the charge polarity of the toner which causes the ordinary fog. The reversal fog gets worse as the fog elimination potential difference Vb becomes larger than 150 V. On the contrary, the ordinary fog gets worse as the fog elimination potential difference Vb becomes smaller than 150 V. In general, the fog elimination potential difference Vb is set so that the fog is to be minimum when changing the fog elimination potential difference Vb.

An invention disclosed, for example, in Japanese Patent Application Laid-open No. 2002-214943 (hereinafter, called Patent Document 1) has been proposed for suppressing such fog. In the image forming apparatus of the invention described in Patent Document 1, the fog toner on the photosensitive drum becomes harder to be transferred to a thick sheet such as a postcard by decreasing contact pressure between an intermediate transfer belt and the photosensitive drum.

However, the following problem still remains with the image forming apparatus described in Patent Document 1. That is, with the image forming apparatus of Patent Document 1, since mechanical parts exist for switching the contact pressure, time loss, namely, productivity reduction of the image forming, is caused. Such productivity reduction of the image forming causes delayed deliveries, sales reduction and profit reduction for printing companies. It is no exaggeration to state that the above is an issue of vital importance.

The present invention provides an image forming apparatus capable of performing high quality image forming by suppressing reversal fog and shadowing while maintaining high productivity without adding a special mechanical part.

To solve the problem, an image forming apparatus includes:

- an image bearing member on which a latent image is formed;
- a development apparatus which develops the latent image formed on the image bearing member with toner;
- a transfer apparatus which transfers the toner image formed on the image bearing member to transfer material;
- an input portion to which information for smoothness of the transfer material onto which the toner image is transferred is inputted; and
- a controller which is capable of controlling a potential difference between a non-image portion potential of the image bearing member and a direct current component potential of bias applied to the development apparatus at the time of forming the toner image based on the information inputted to the input portion, the controller being capable of controlling to decrease the potential difference in a case that the information inputted to the input portion is equal to or higher than a predetermined smoothness as compared to a case of being lower than the predetermined smoothness.

Further features of the present invention will become apparent from the following description of exemplary embodiments (with reference to the attached drawings).

BRIEF DESCRIPTION OF THE DRAWINGS

FIG. 11 is a plane view which describes configurations, conditions and settings of the image forming apparatus;

FIG. 12 is a table which describes performances for respective configurations, conditions and settings of the image forming apparatus;

DESCRIPTION OF THE EMBODIMENTS

Figure 1:
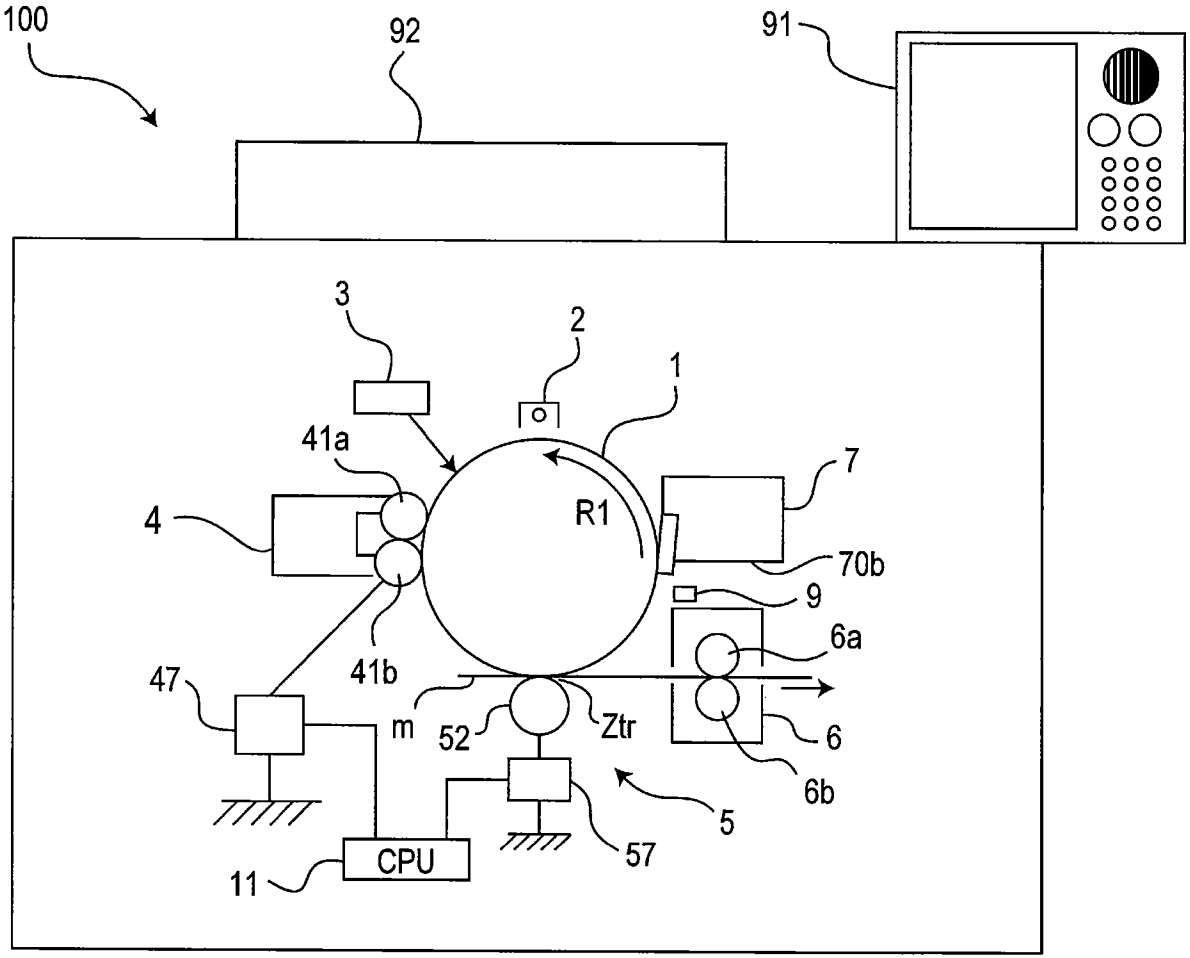
FIG. 1 is a schematic view of an image forming apparatus according to a first embodiment of the invention.

In the following, an image forming apparatus according to an embodiment of the present invention will be described in detail with reference to the drawing. Here, unless otherwise specified, dimensions, materials, shapes, relative positions thereof and the like of the configuration parts described in the embodiments are not for limiting the scope of the invention to such.

First embodiment

FIG. 1 is a configuration view of an image forming apparatus 100 according to the first embodiment of the present invention. As illustrated in FIG. 1, the image forming apparatus 100 has a rotation drum type electrophotographic sensitive drum (hereinafter, called "the pnotosensitive drum") 1 as "an image bearing member". For example, the photosensitive drum 1 is formed having a diameter of 90 mm. Here, an amorphous silicone photosensitive member is used. The photosensitive drum 1 is driven to rotate in the rotation direction of R1 at a predetermined peripheral speed. Image forming processes of the later-mentioned output image forming are repeatedly performed at the surface thereof.

A primary charger 2, an exposure device 3, a development device 4, a secondary transfer roller 52, a toner density sensor 9 and a cleaning device 7 are arranged around the photosensitive drum 1 in the order of the rotation direction R1 of the photosensitive drum 1. The primary charger 2 charges the photosensitive drum 1. The exposure device 3 forms an electrostatic image by exposing the photosensitive drum 1. The development device 4 having developer bearing members 41*a*, 41*b* which bear developer and develop a latent image formed on the photosensitive drum 1 into a toner image visualizes the electrostatic image formed on the photosensitive drum 1 as a toner image. The development device 4 is capable of transferring toner to the surface of the photosensitive drum 1. The development device 4 has the developer bearing members 41*a*, 41*b*. A development bias supply 47 capable of applying development bias to the development device 4 is connected to the developer bearing members 41*a*, 41*b*. A transfer bias supply 57 is connected to the secondary transfer roller 52. A transfer portion Ztr is formed between the photosensitive drum 1 and the secondary transfer roller 52. A fixing device 6 is arranged at the downstream side in the conveying direction of a sheet m which is "transfer material". A toner density sensor 9 which is "toner density detection unit" is arranged at a position being apart from the surface of the photosensitive drum 1 by 15 mm and being below an outer bottom 70*b* of the cleaning device 7 by 10 mm. The toner density sensor 9 is capable of detecting toner density existing on the surface of the photosensitive drum 1. The development bias supply 47 and the transfer bias supply 57 are connected to a central processing unit (CPU) 11 as a "controller" which is "a control apparatus". Here, "a transfer apparatus" is configured to include the secondary transfer roller 52.

At a time period other than an output image forming period for forming an image to be outputted, the CPU 11 is capable of changing the development bias to a predetermined value from that of the development bias in the output image forming period. Accordingly, the CPU 11 is capable of controlling the transfer of the charge polarity reversal toner having reversed charge polarity to the surface of the photosensitive drum 1 from the development device 4.

In addition, the CPU 11 is capable of determining "the time period for transferring the charge polarity reversal toner" or "the transferring amount of the charge polarity reversal toner" based on the toner density detected by the toner density sensor 9. For the determination of changing "the time period for transferring the charge polarity reversal toner", the CPU 11 changes the applying time of the development bias. For the determination of changing "the transferring amount of the charge polarity reversal toner", the CPU 11 changes the voltage of a direct current component of the development bias.

Further, the CPU 11 controls an absolute value of fog elimination potential difference Vb between non-image portion potential Vni and direct current component potential Vdevdc based on smoothness FS which is "the information of smoothness" inputted to an operation apparatus 91. That is, the CPU 11 determines whether or not the smoothness FS inputted to the operation apparatus 91, which is the later-mentioned "input portion", is the information that the sheet m on which a toner image is transferred has a predetermined smoothness or higher. When the smoothness FS is equal to or higher than the predetermined smoothness, the CPU 11 controls to decrease the fog elimination potential difference Vb between the non-image portion potential Vni of the photosensitive drum 1 and the direct current component potential Vdevdc of the bias applied to the developer bearing members 41*a*, 41*b* compared to the case of being lower than the predetermined smoothness.

In the following, image forming processes of the image forming apparatus 100 will be briefly described. The photosensitive drum 1 is evenly charged at a predetermined polarity and predetermined surface voltage by the primary charger 2 of a corona discharge type and the like. Next, the photosensitive drum 1 receives image exposure light Lim from the exposure device 3 which is configured with an imaging exposure optical system based on color separation of a color original image and a scanning exposure optical system with a laser scanner outputting laser beams modulated in accordance with electric digital pixel signals in time sequence of image information. In this manner, the electrostatic image corresponding to a target image is formed on the photosensitive drum 1. Subsequently, the abovementioned development device 4 performs developing so as to visualize as a toner image.

Next, the sheets m are separated and conveyed one by one from a sheet cassette (not illustrated) by a sheet feeding roller so as to be fed to the transfer portion Ztr which is the opposing part between the photosensitive drum 1 and the transfer device 5 at predetermined timing via a pair of registration rollers and a transfer guide. The transfer bias is applied to the transfer device 5 by the transfer bias supply 57, so that the toner image is transferred on the sheet m.

By repeating the abovementioned series of image forming processes, toner images are to be transferred to the subsequent sheets m fed to the transfer portion Ztr one after another. The sheet m on which the toner image of the photosensitive drum 1 is transferred is conveyed to the fixing device 6 via a conveying guide and conveyed to a contact part of a pressure roller 6*b* and a fixing roller 6*a* controlled to be a predetermined temperature with heating. Hence, the sheet m receives a toner image fixing process by being heated and pressed, and then, is outputted as a final image-formed work. Meanwhile, remaining toner on the photosensitive drum 1 after the toner image transfer is performed is cleaned by the cleaning device 7.

By the way, during output image forming, first, the surface of the photosensitive drum 1 is evenly charged by the primary charger 2 of the corona discharge type. Then, the image exposure with PWM is performed by the exposure device 3 of a semiconductor laser.

Figure 2:
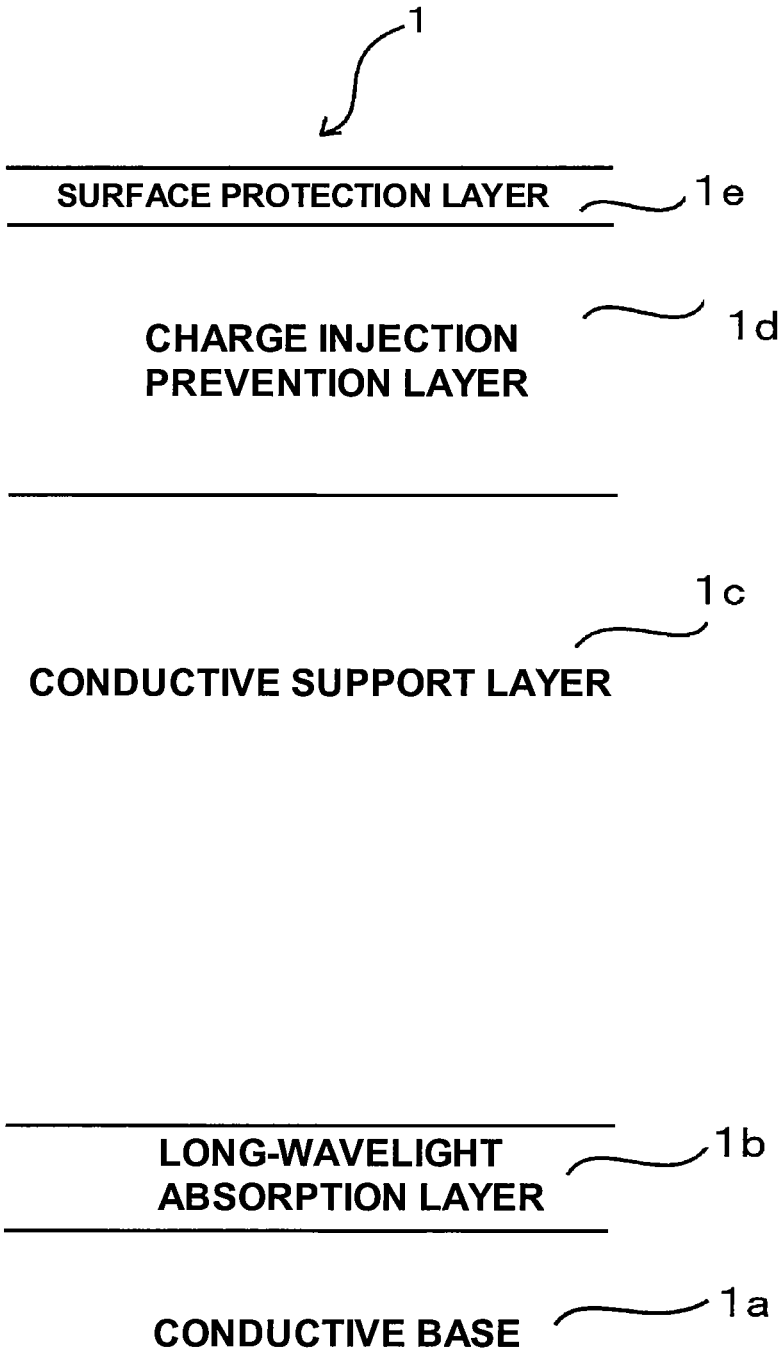
FIG. 2 is a sectional view which illustrates layers of a photosensitive drum.

FIG. 2 is a sectional view which illustrates layers of the photosensitive drum 1. As illustrated in FIG. 2, a conductive base 1*a* having 3 mm thickness made of aluminum alloy at the center portion utilizing amorphous silicone is arranged at a photosensitive layer of the photosensitive drum 1. A long-wave light absorption layer 1*b* having 1 μm thickness to prevent reflection from the conductive base 1*a* is arranged above the conductive base 1*a*. A conductive support layer 1*c* similar to the conductive base 1*a* having 25 μm thickness is arranged above the long-wave light absorption layer 1*b*. A charge injection prevention layer 1*d* having 3 μm thickness is arranged above the conductive support layer 1*c*. The charge injection prevention layer 1*d* is arranged to prevent charge injection from the conductive support layer and base and is formed of material of at least amorphous silicone series so as to be a photoconductive layer having photoconductivity. A surface protection layer 1*e* having 0.5 μm thickness to protect the charge injection prevention layer 1*d* is formed above the charge injection prevention layer 1*d* to be the layer at the outer boundary. The photosensitive drum 1 includes amorphous silicone. Accordingly, the photosensitive drum 1 has high wearability and a long replacement cycle. Therefore, maintenance time can be decreased and high productivity can be maintained.

The photosensitive drum 1 is driven to rotate at the speed of 500 mm/s in the rotation direction R1 and the later-mentioned image forming processes of output image forming are repeatedly performed on the surface thereof. The period for regular replacement is extremely long as pages of 30 million on a basis of continuous outputting page number in lateral feeding of JIS-A4 size sheet. This is a feature of the photosensitive drum 1 utilizing amorphous silicone as the photosensitive layer. Here, the continuous outputting speed in the lateral feeding of JIS-A4 sheet is 100 pages per minute.

The movement speed at the surface of the photosensitive drum 1 is set to be 500 mm/s or faster for the image forming. Thus, since the movement speed at the surface of the photosensitive drum 1 is not to be slow, high productivity can be maintained. Further, the cleaning device 7 to remove toner from the surface of the photosensitive drum 1 is separately arranged. Therefore, the cleaning ability on the surface of the photosensitive drum 1 is high, so that the movement speed at the surface of the photosensitive drum 1 can be increased. Accordingly, the image outputting can be performed with high productivity and high image quality having less fog. Further, the movement speed of the photosensitive drum 1 during the image forming is set to be constant without reference to the type of the sheets m. Thus, since there is no amount of time incapable of forming an image due to surface speed changing of the photosensitive drum 1, high productivity can be maintained.

Figure 3:
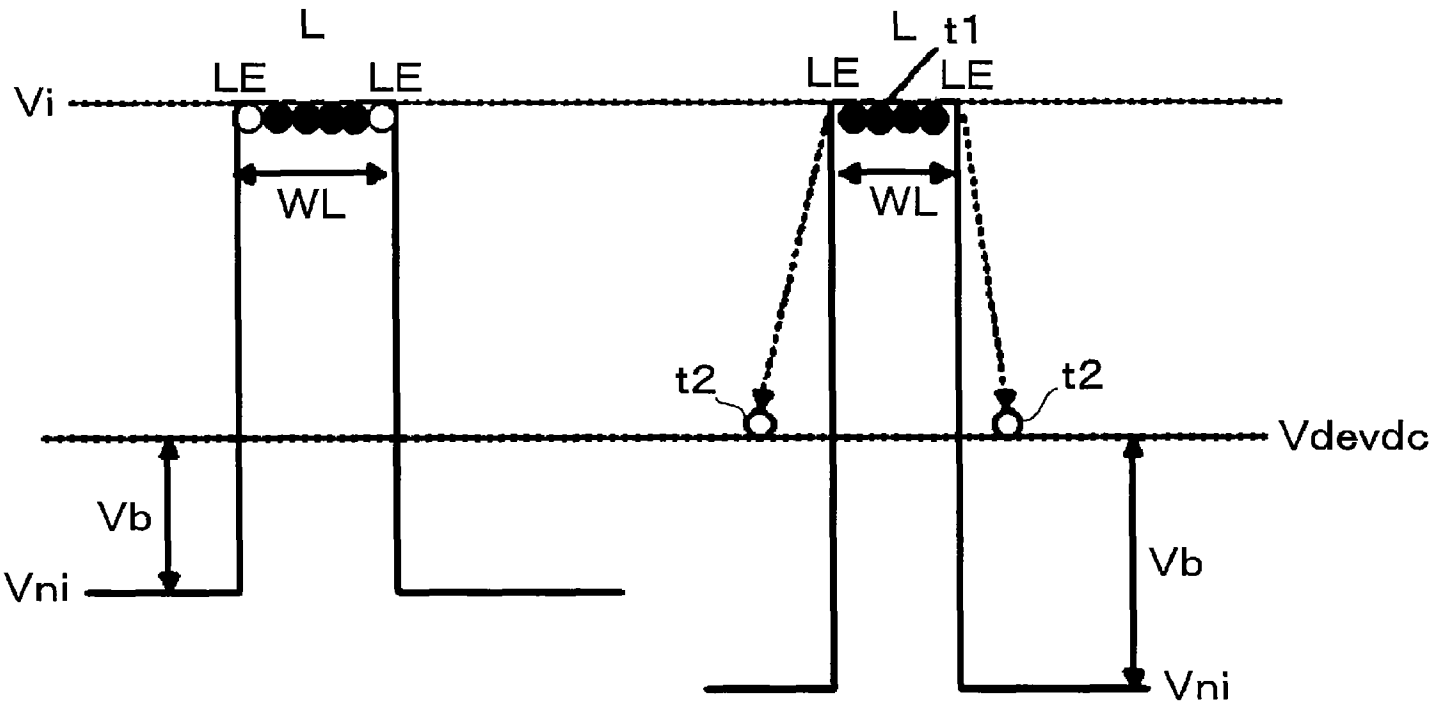
FIG. 3 is a graph which illustrates the relation between potential of the photosensitive drum and direct current component potential of development bias.

FIG. 3 is a graph which illustrates the relation between the potential of the photosensitive drum 1 and the direct current component potential of the development bias. When the CPU 11 starts the control of the image forming, the photosensitive drum 1 starts to rotate. As illustrated in FIG. 3, the surface of the photosensitive drum 1 is evenly charged to the potential Vi of +500 V by the primary charger 2 of the corona discharge type. Next, the photosensitive drum 1 receives the image exposure light Lim from the exposure device 3 which is configured with the imaging exposure optical system based on color separation of a color original image and the scanning exposure optical system with a laser scanner outputting laser beams modulated in accordance with electric digital pixel signals in time sequence of image information. Accordingly, the electrostatic image (having non-image portion potential Vni at +150 V) corresponding to the image to be outputted is formed.

The exposure method of the present embodiment is a background exposure method. That is, the absolute value of the potential Vi of the photosensitive drum 1 at a portion where a toner image is to be formed is larger than that of the non-image portion potential Vni of the photosensitive drum 1 at a portion where a toner image is not to be formed.

The potential at the portion which does not receive the image exposure light Lim remains at Vi. Here, in the description of the present embodiment, the background exposure method is utilized as the exposure method. However, not limited to this, the present invention can be adopted even with a method to perform exposure on a portion where a toner image is to be formed, for example.

Figure 4:
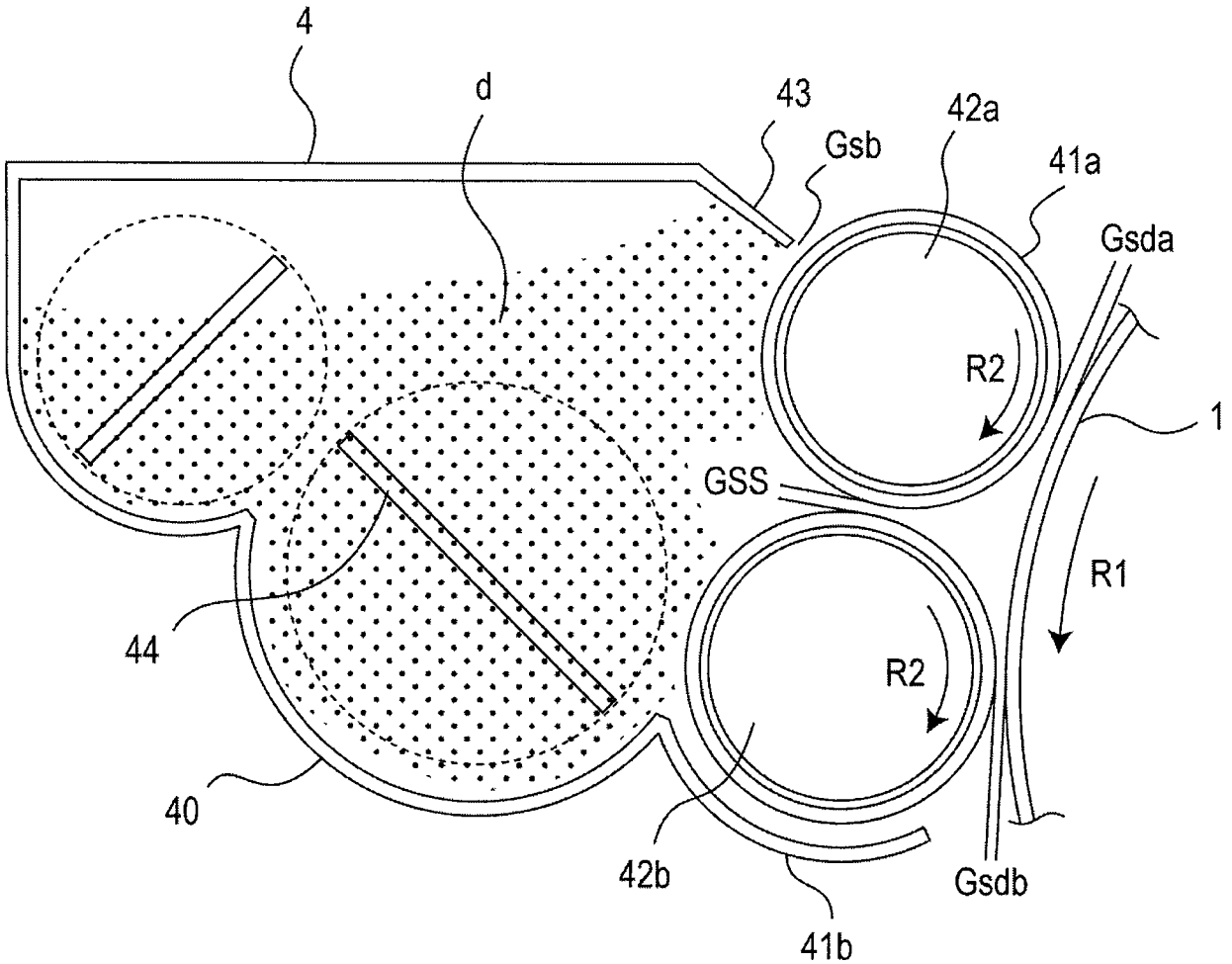
FIG. 4 is a sectional view which illustrates a section of a development device.

FIG. 4 is a sectional view which illustrates a section of the development device 4. The development device 4 arranged in a fixed manner to develop the electrostatic image will be described with reference to FIG. 4. A development container 40 accommodates developer d and has an opening portion extending in the longitudinal direction of the photosensitive drum 1 (i.e., the direction perpendicular to the paper surface of FIG. 4). The developer bearing members 41*a*, 41*b* are arranged at the opening portion. The developer bearing members 41*a*, 41*b* are formed of material such as aluminum and SUS to be respectively shaped cylindrical having the outer diameter of 25 mm. As illustrated in FIG. 4, the developer bearing members 41*a*, 41*b* are rotatably arranged laterally to oppose to the photosensitive drum 1 as an approximate left half circumferential surface being projected to the inside of the development container 40 and an approximate right half circumferential surface being exposed to the outside of the development container 40. The plurality of developer bearing members 41*a*, 41*b* convey the developer d toward the position closest to the photosensitive drum 1 by being rotated while bearing the developer d. With this configuration, the developing time can be long and different functions can be respectively assigned to the plurality of developer bearing members 41*a*, 41*b* so as to enable image outputting of high image quality without tailing.

A gap Gsda of 200 μm is arranged between the developer bearing member 41*a* and the photosensitive drum 1 and a gap Gsdb of 300 μm is arranged between the developer bearing member 41*b* and the photosensitive drum 1. Both of the developer bearing members 41*a*, 41*b* are driven to rotate at the speed of 600 mm/s in the rotation direction R2 being the same direction as the rotation direction R1 of the photosensitive drum 1 at the opposing part.

Permanent magnets 42*a*, 42*b* are fixedly arranged inside the respective developer bearing members 41*a*, 41*b* as "magnetic field generation unit".

A plate-shaped developer amount restriction member 43 which is "a developer restriction member" is arranged at the vicinity of the developer bearing member 41*a* as the fixed end thereof being supported by the opening portion of the developer container 40 and the free end thereof being positioned adjacent to the developer bearing member 41*a*. One magnetic pole of the permanent magnet 42*a* is arranged approximately opposed to the developer amount restriction member 43.

The developer d conveyed and borne on the developer bearing member 41*b* by a developer agitating-conveying member 44 is conveyed to the opposing part of the developer bearing member 41*b* and the developer bearing member 41*a* in accordance with the rotation of the developer bearing member 41*b* thereafter. The developer d is formed to be a thin layer on the developer bearing member 41*b* by the action of the magnetic field generated at the gap Gss between the developer bearing members 41*b*, 41*a*. Then, the developer d is conveyed to the gap Gsdb against the photosensitive drum 1 and development is performed.

By applying development bias to the developer bearing members 41*a*, 41*b* with the development bias supply 47, the toner in the developer d borne on the developer bearing members 41*a*, 41*b* is transferred and fixed to the electrostatic image on the photosensitive drum 1, so that the electrostatic image is visualized as the toner image.

The developer d may be formed of only magnetic toner without including carrier particles. In that case, since toner splash is less and carrier replacement is not required, high productivity can be maintained with less maintenance time.

Figure 5:
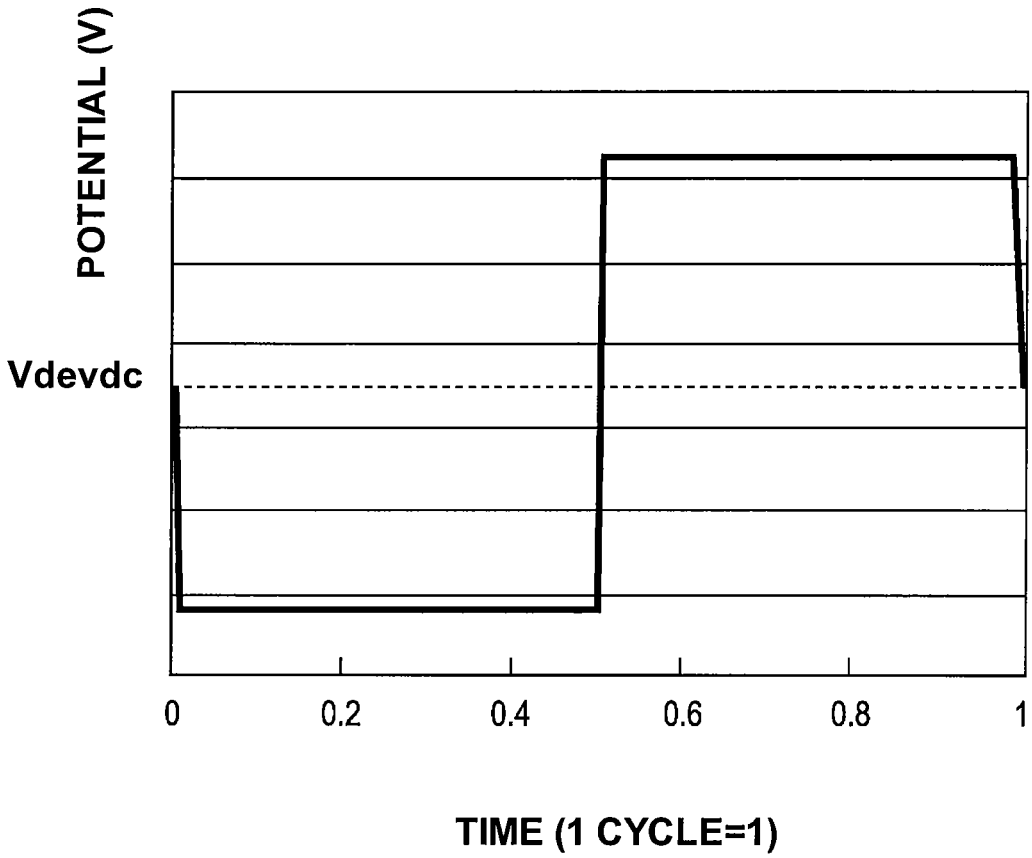
FIG. 5 is a graph which illustrates a waveform of the development bias.

FIG. 5 is a graph which illustrates a waveform of the development bias. As illustrated in FIG. 5, the development bias is a rectangular wave having an alternate current component superimposed with a direct current component. The frequency is 3 kHz, the development bias amplitude Vpp is 0.75 kV, and the development bias wave height Vp2 is 1.5 kV. "The average potential", namely, the direct current component potential, is 270 V.

Here, the action after the development by the development device 4 will be described with reference to FIG. 3. The developer d accommodated in the development container 40 is constituted of magnetic toner and the like and is charged with friction between the surfaces of the developer amount restriction member 43 and the developer bearing member 41.

Next, the sheets m are fed one by one from the sheet feeding apparatus (not illustrated) to the opposing part of the photosensitive drum 1 and the transfer device 5 at predetermined timing. The transfer bias is applied to the transfer device 5 by the transfer bias supply 57, and then, the toner image on the surface of the photosensitive drum 1 is transferred on the sheet m by the action of the magnetic field. By repeating the abovementioned series of image forming processes, toner images are to be transferred to the subsequent sheets m fed to the opposing part one after another.

The sheet m on which the toner image on the photosensitive drum 1 is transferred is conveyed to the fixing device 6. The sheet m receives the toner image fixing process by being heated and pressed at the contact part of the pressure roller 6*b* and the fixing roller 6*a* controlled to be the predetermined temperature. Then, the sheet m is outputted as a final image-formed work.

Meanwhile, remaining toner on the photosensitive drum 1 after the toner image transfer is performed is cleaned by the cleaning device 7. The cleaning device 7 is configured with an elastic plate-shaped member (not illustrated) such as rubber contacting to the photosensitive drum 1 and a permanent magnetic roller (not illustrated) not contacting to the photosensitive drum 1.

Figure 6:
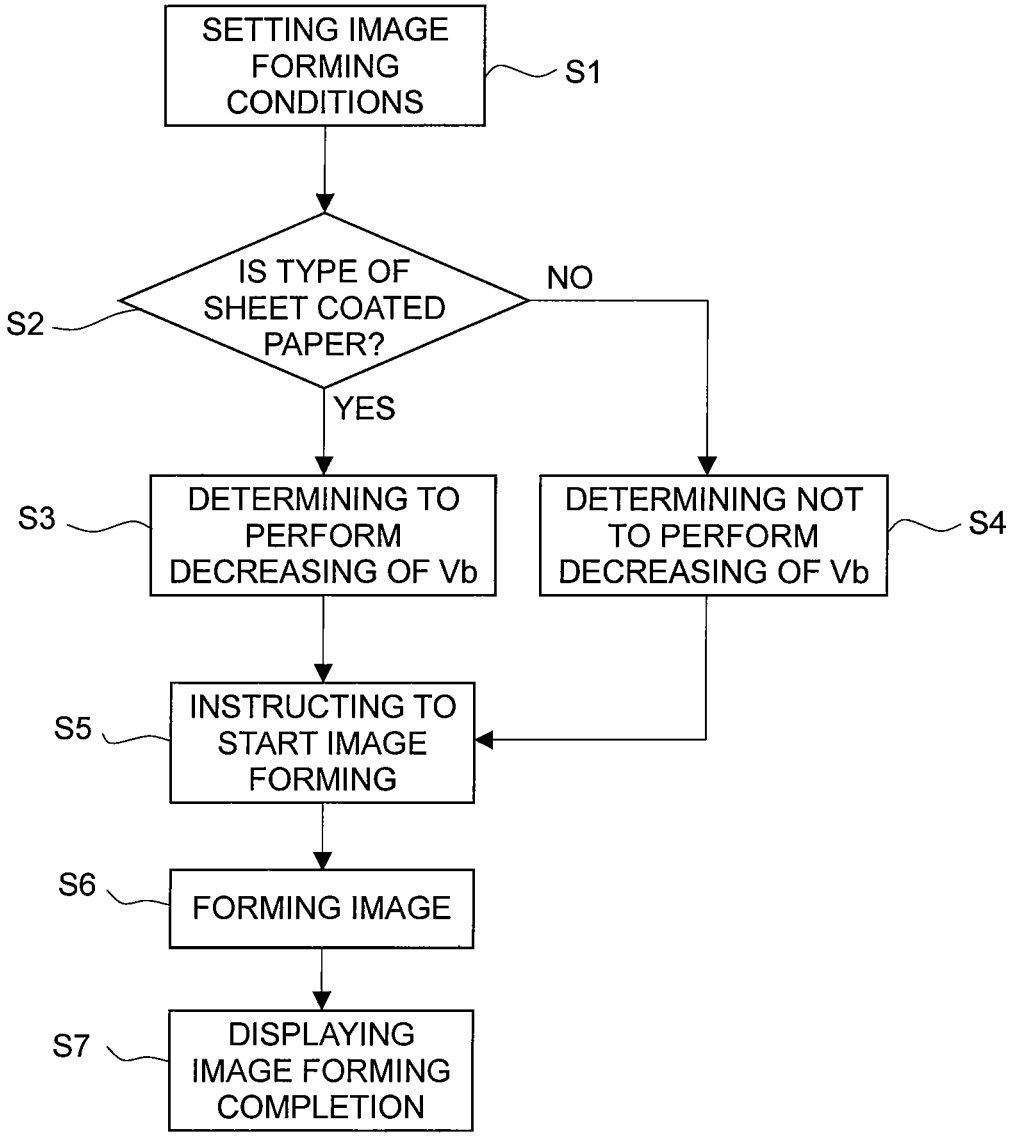
FIG. 6 is a flowchart which describes a control process of a controller.

FIG. 6 is a flowchart which describes the control process of the CPU 11. The control process of the CPU 11 is the feature of the present embodiment. As illustrated in FIG. 6, the CPU 11 as "a controller" being "a control apparatus" receives image forming conditions. That is, the CPU 11 receives the image forming conditions such as the type of the sheets m, the number of sheets m and after-treatment from the operation device 91 being "the input portion" to which sheet information for image forming is inputted (step 1, i.e., S1, hereinafter, a step is simply described as S).

Next, the CPU 11 acknowledges the sheet information by searching a sheet database stored at the inside or outside of the image forming apparatus 100 based on the inputted sheet information. That is, the CPU 11 determines whether or not the type of the sheets m is coated paper (S2).

In the case of "YES" (i.e., the type of the sheet m is determined to be "coated paper" based on the inputted image forming conditions), the CPU 11 controls an exposure device drive portion 37 and the development bias supply 47 so that the fog elimination potential difference Vb is to be 120 V (S3). That is, the CPU 11 decreases the fog elimination potential difference Vb. By the action of the above, the reversal fog is decreased. The fog elimination potential difference Vb is defined as the difference between the direct current component potential Vdevdc of the development bias applied to the developer bearing member constituting the development device 4 and the non-image portion potential Vni of the photosensitive drum 1.

In the case of "NO" (i.e., the type of the sheet is determined not to be "coated paper" based on the inputted image forming conditions), the CPU 11 determines not to perform decreasing of the fog elimination potential difference Vb (S4).

When a copy start button is pressed (S5), the CPU 11 performs image forming (S6), and displays completion of the image forming (S7). After the completion, the operation apparatus 91 displays that the performance of new image forming is possible.

Figure 7:
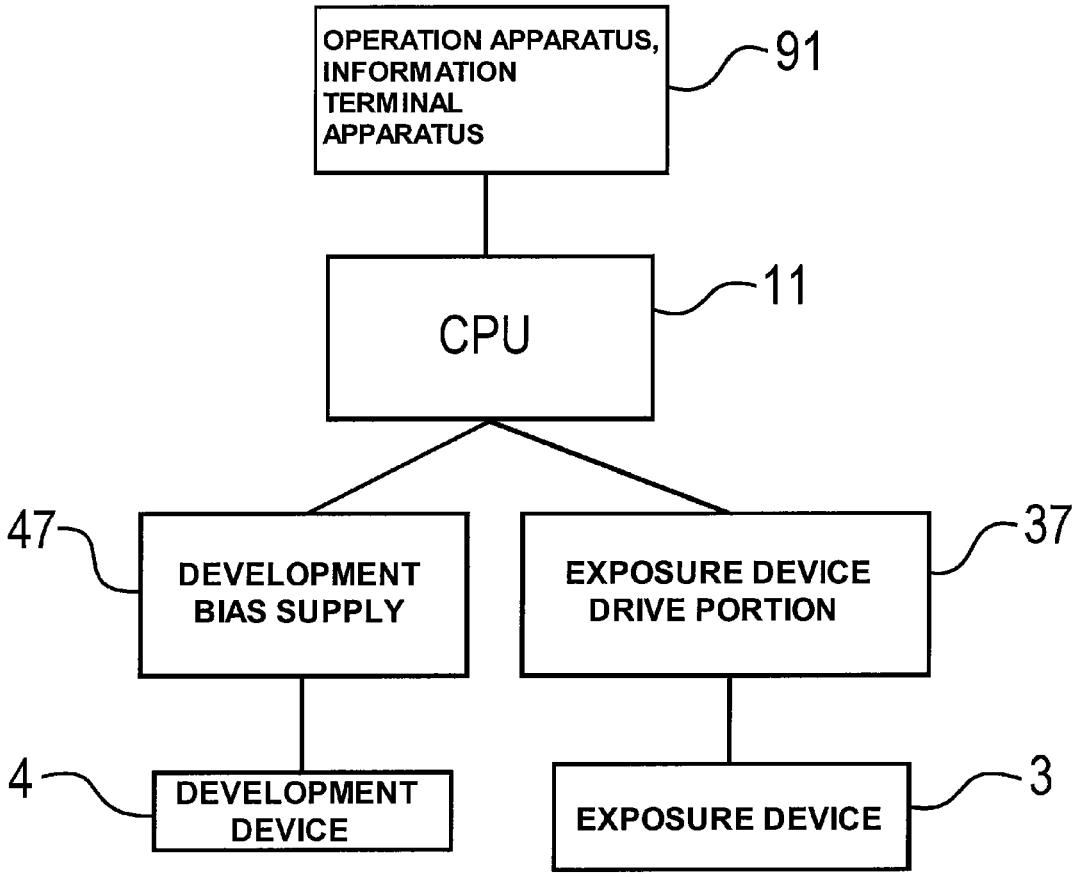
FIG. 7 is a block diagram which illustrates wiring relation among an operation apparatus, the development device and an exposure device.

FIG. 7 is a block diagram which illustrates wiring relation among the operation apparatus 91, the development device 4 and the exposure device 3. Smoothness information regarding the smoothness of the sheet to which the toner image is transferred is inputted to the operation apparatus 91. As illustrated in FIG. 7, the CPU 11 is connected to the operation apparatus 91. The development bias supply 47 and the exposure device drive portion 37 are connected to the CPU 11. The development device 4 is connected to the development bias supply 47 and the exposure device 3 is connected to the exposure device drive portion 37. The operation apparatus 91 being "the input portion" as illustrated in FIG. 7 is arranged at the image forming apparatus 100. Sheet information as illustrated in FIG. 8 which is described later is inputted to the operation apparatus 91.

Figure 8:
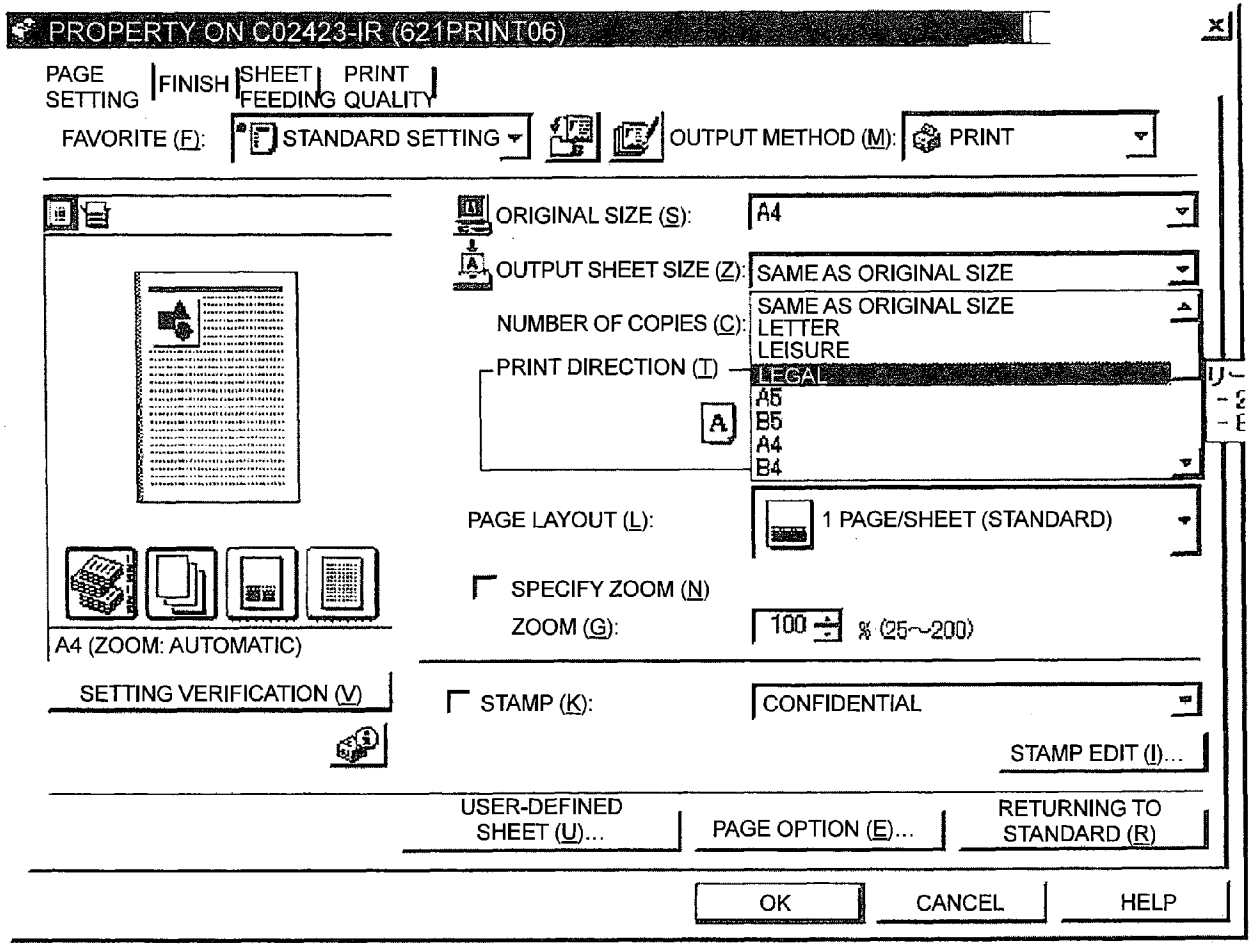
FIG. 8 is a front view of a setting screen of print software.

FIG. 8 is a front view of a setting screen of print software. For inputting the information of the sheet m, an information terminal apparatus capable of inputting information from an information terminal such as a personal computer is utilized. The type of the sheet m includes dimensions (for example, A3), grammage (for example, 105 g/m$^2$) and surface nature (for example, coated paper). As the type of the sheet, it is also possible to input name of the sheet m (for example, office planner (trademark)) or a JAN code.

Figure 9:
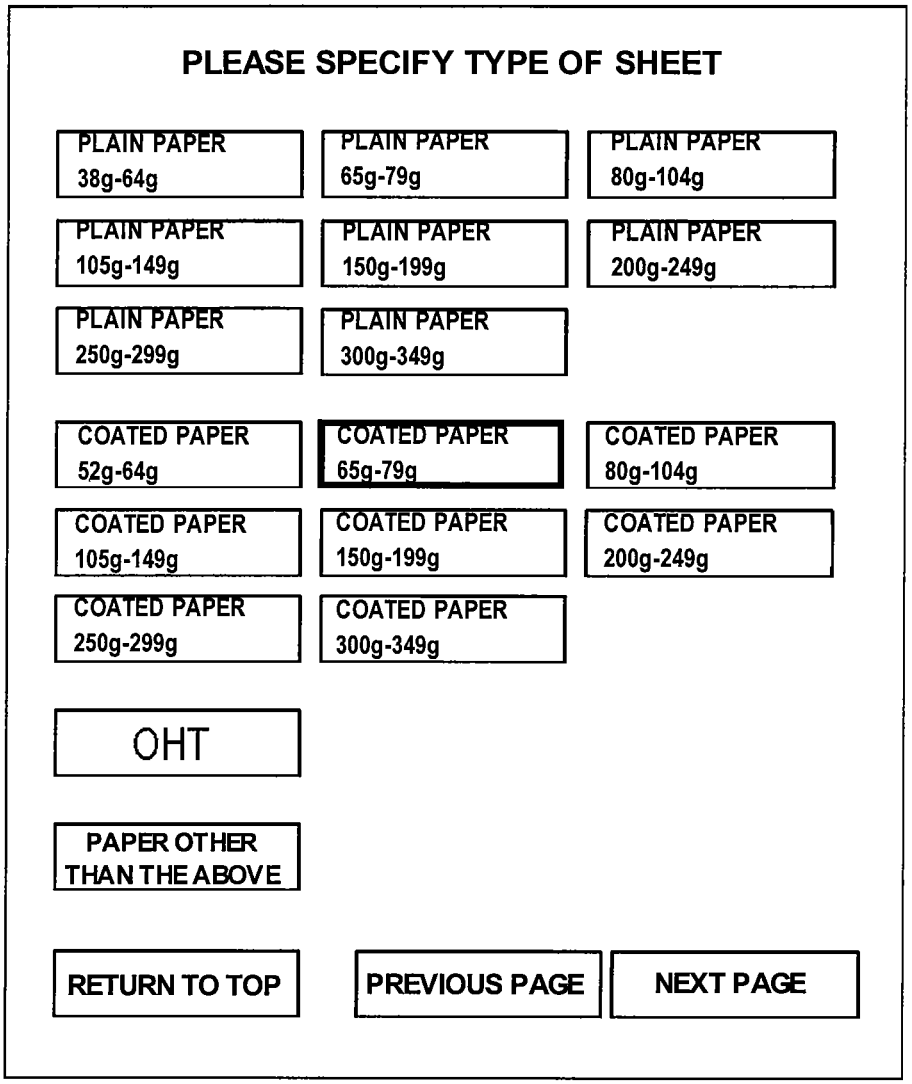
FIG. 9 is a schematic view which illustrates a display screen of the operation apparatus.

FIG. 9 is a schematic view which illustrates a display screen of the operation apparatus 91. As illustrated in FIG. 9, a plurality of types of the sheets m such as paper types are displayed on the display screen of the operation apparatus 91.

Figure 10:
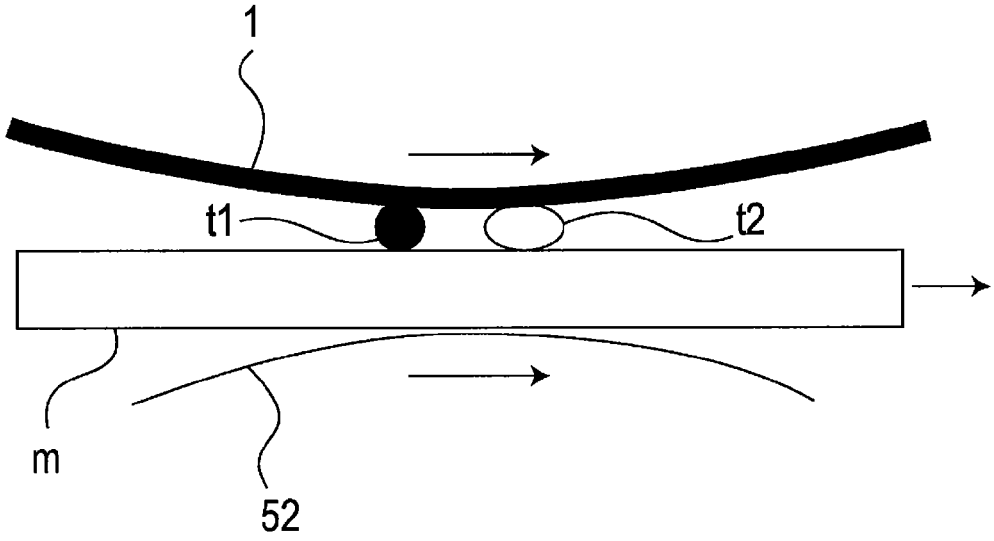
FIG. 10 is a schematic view which illustrates the principle of occurrence of shadowing due to ordinary charge toner.
Figure 25:
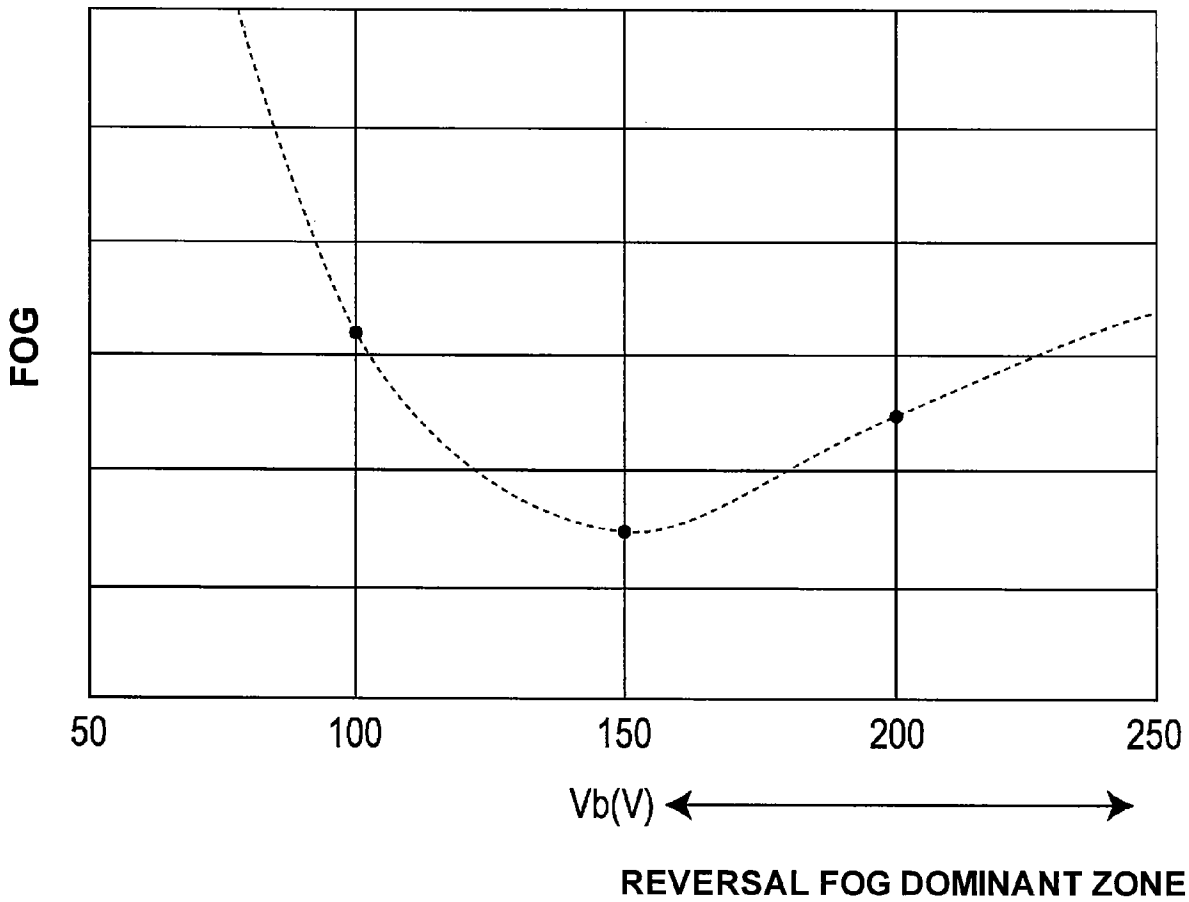
FIG. 25 is a graph which illustrates the relation between the fog and the fog elimination potential difference.
Figure 26:
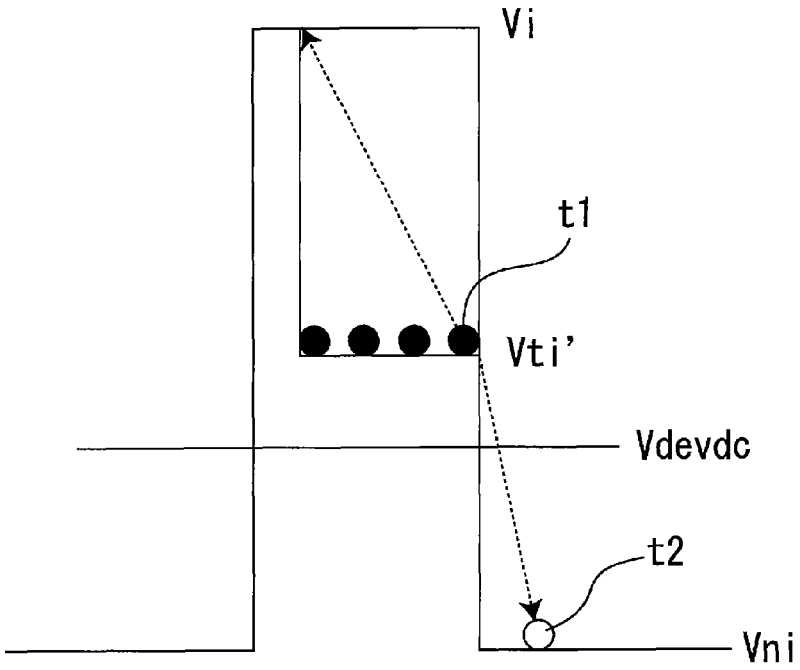
FIG. 26 is a view which describes the force the toner receives from an electric field at the front and rear end parts of an image.

FIGS. 10 and 26 are schematic views which describe the principle of the occurrence of the reversal fog and shadowing due to the reversal charge toner. Although the ordinary fog is increased (see the above-mentioned description for FIG. 25), the shadowing is improved when the fog elimination potential difference Vb is decreased.

The first reason of the above is that the development electric field strength against the reversal charge toner which mainly constitutes the reversal fog and the shadowing is decreased when the fog elimination potential difference Vb is decreased. The second reason is that particle diameters of the ordinary low charge toner t1 causing the ordinary fog are smaller than those of the reversal charge toner t2. Thus, since the gap with the sheet m is large at the time of transferring, the transfer pressure is low. Accordingly, the ordinary low charge toner t1 is not transferred on the sheet m as shadowing. In addition, since the particle diameters of the ordinary low charge toner t1 causing the ordinary fog are smaller than those of the reversal charge toner t2, the ordinary low charge toner t1 is to be inconspicuous even in the case that the same number of particles exist on the sheet m. Here, particle diameters of the ordinary low charge toner t1 and the reversal charge toner t2 are larger than those of the appropriate charge toner.

On the contrary, when the fog elimination potential difference Vb is increased, the development electric field strength against the reversal charge toner which constitutes the reversal fog and the shadowing is increased. In this case, the reversal fog and the shadowing get worse.

Although details are not ascertained regarding the mechanism of shadowing occurrence and the reason why the shadowing is caused by the reversal charge toner t2, the following is considered. That is, the difference (ΔVt1) between the non-image portion potential Vni of the photosensitive drum 1 and the direct current component potential Vdevdc of the developer bearing member is large at the part where the reversal charge toner t2 causes the shadowing. Therefore, there is influence of force of the electric field to move the reversal charge toner t2 included at the image portion to the non-image portion (i.e., the wraparound electric field).

On the contrary, the reason why the ordinary low charge toner t1 does not cause the shadowing is considered to be that the ordinary low charge toner t1 receives force by the electric field in the direction toward the image portion (see FIG. 26).

When the type of the sheet is not "coated paper", the CPU 11 controls the exposure device drive portion 37 so that the fog elimination potential difference Vb is to be 150 V.

FIG. 11 indicates configurations, conditions and settings of the image forming apparatus according to the embodiments of the present invention. FIG. 12 indicates performances for respective configurations, conditions and settings of the image forming apparatus according to the embodiments of the present invention. Superiority of the image forming apparatus according to the embodiments of the present invention can be seen from these tables. Here, "*1" in FIG. 12 indicates data regarding outputting booklets, the booklet being outputted in the conditions of forming the front cover and the back cover with coated paper of A4 size and including 100 pages of non-coated paper of A4 size having 5% of image area ratio with duplex printing. In FIG. 12, "0" indicates non-occurrence of the phenomenon and "X" indicates occurrence of the phenomenon.

Here, in the present embodiment, the sheet information is obtained from the operation apparatus 91 (see FIG. 9). However, not limited to this, it is also possible that a detection unit to detect the surface of the sheet m is arranged and the CPU 11 obtains a detection result of the detection means and controls the fog elimination potential difference Vb, for example.

Figure 13:
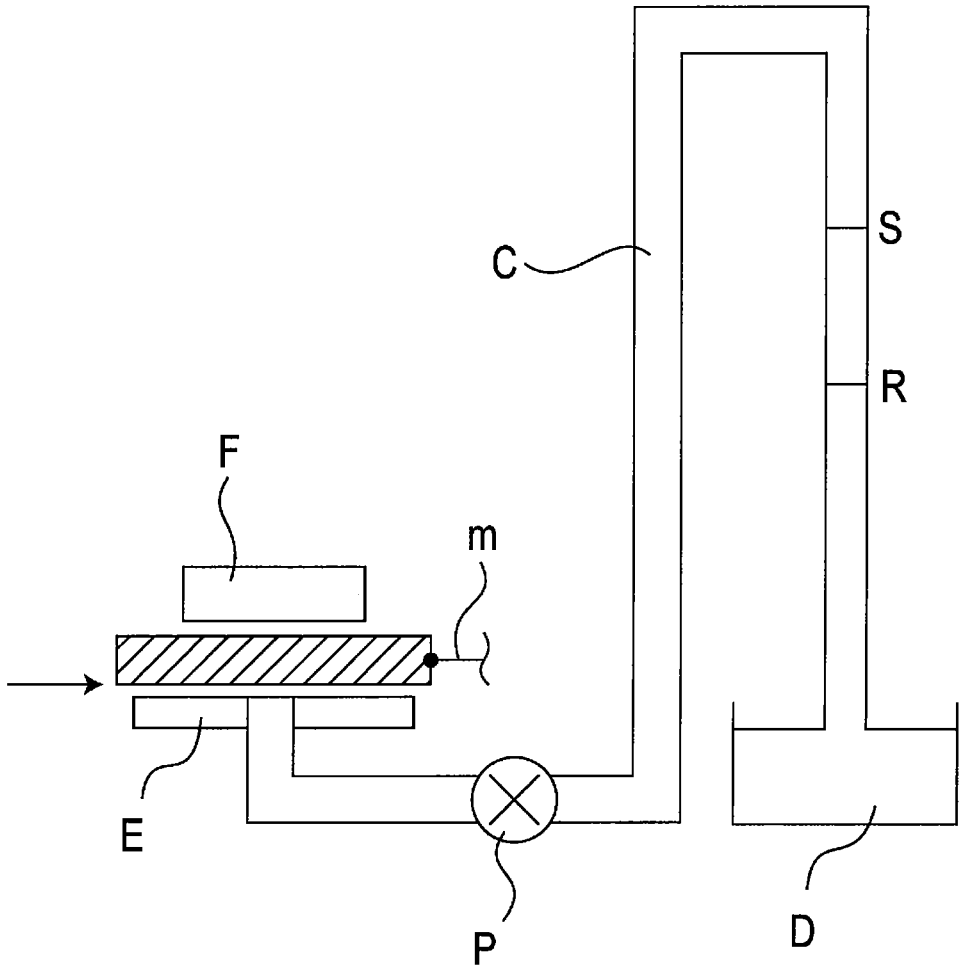
FIG. 13 is an explanatory view of the measurement principle of smoothness.

FIG. 13 is an explanatory view of the measurement principle of the smoothness. In order to measure the smoothness, a measure method of a Beck's method is adopted, for example. This is the method to measure the smoothness of the sheet m by utilizing air. As illustrated in FIG. 13, the sheet m is placed on a base plate E as the face to be measured face-downward. A weight F is placed on the sheet m. When the air in a connection pipe C is depressed, distilled water D is raised from height R to height S. When the depressing operation is stopped after the distilled water D is raised to height S, air flows in through the space between the base plate E and the sheet m and the distilled water is dropped from height S to height R. The inflow amount of the air is set to be 10 ml for dropping from height S to height R. The time for the inflow of air of 10 ml is to be the value of smoothness of Beck's method. When the surface of the sheet m is rough, it is easy for the air to flow in through the space between the base plate E and the sheet m. Accordingly, the time is shortened and the smoothness is to be a low value. When the surface of the sheet m is fine, it is difficult for the air to flow in through the space between the base plate E and the sheet m. Accordingly, the time is prolonged and the smoothness is to be a high value. For example, "the predetermined smoothness" is set to correspond to 2500 seconds measured by a Beck's method smoothness meter.

Second Embodiment

An image forming apparatus according to the second embodiment of the present invention has the same configuration as the image forming apparatus 100 according to the first embodiment. Hence, the same numerals are given and the description will not be repeated in an appropriate manner. The following point is the feature of the image forming apparatus according to the second embodiment of the present invention. That is, in the second embodiment, the CPU 11 determines whether or not the smoothness FS being "the information regarding the smoothness" inputted to the operation apparatus 91 is the information indicating that smoothness of the sheet m to which a toner image is transferred is equal to or higher than the predetermined smoothness. Then, when the smoothness FS is equal to or higher than the predetermined smoothness, the CPU 11 decreases the development bias amplitude Vpp which is "the amplitude of the development bias" compared to the case of being lower than the predetermined smoothness. That is, in the image forming apparatus according to the second embodiment, the CPU 11 decreases the development bias amplitude Vpp as well as decreasing the absolute value of the fog elimination potential difference Vb when the smoothness FS is determined to be equal to or higher than the predetermined smoothness. The reason for decreasing the development bias amplitude Vpp is to suppress the phenomenon that line width becomes wide when the absolute value of the fog elimination potential difference Vb is decreased.

In the following, the principle of increasing of the line width WL when the fog elimination potential difference Vb is set small will be described with reference to FIG. 3. As illustrated in FIG. 3, when the fog elimination potential difference Vb is set large, the electric field between the end part LE of a line L and the background is strengthened. Accordingly, it becomes difficult for the reversal charge toner in the toner to be developed to adhere to the end part LE, so that the line width WL is decreased. On the contrary, when the fog elimination potential difference Vb is set small, the electric field between the end part LE of the line L and the background is weakened. Accordingly, the reversal charge toner in the toner to be developed becomes easy to be adhered to the end part LE, so that the line width WL is increased.

Figure 14:
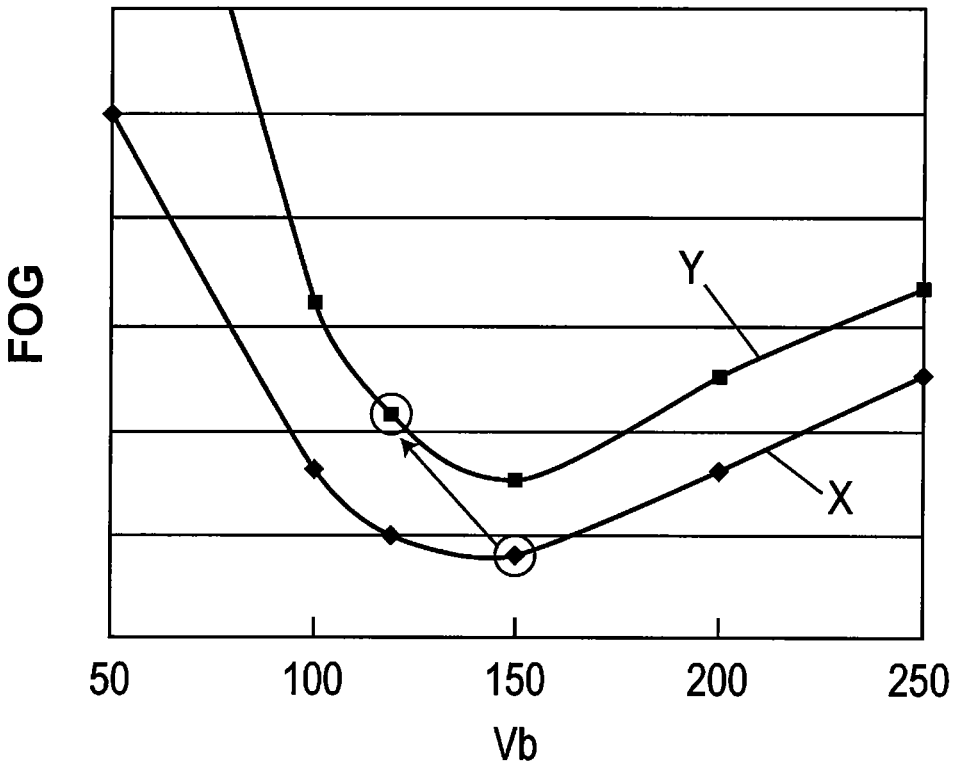
FIG. 14 is a graph which illustrates the relation between the fog and the fog elimination potential difference for an image forming apparatus according to a second embodiment of the present invention.

FIG. 14 is a graph which illustrates the relation between the fog and the fog elimination potential difference Vb. Line X in FIG. 14 indicates a graph of the fog elimination potential difference Vb to be set in the case of a normal sheet. Line Y in FIG. 14 indicates a graph of the fog elimination potential difference Vb to be set in the case of a specific sheet. When the fog elimination potential difference Vb is decreased to be 120 V by controlling the exposure device drive portion 37 and the development bias supply 47 with the CPU 11, the ordinary fog is increased although the reversal fog is decreased. In this case, since the line width WL is to be increased, the CPU 11 controls the development bias supply 47 so as to set the development bias amplitude Vpp to be 0.5 kV and the development bias wave height Vp2 to be 1 kV. Accordingly, the ordinary fog is decreased and the line width WL becomes appropriate.

Figure 15:
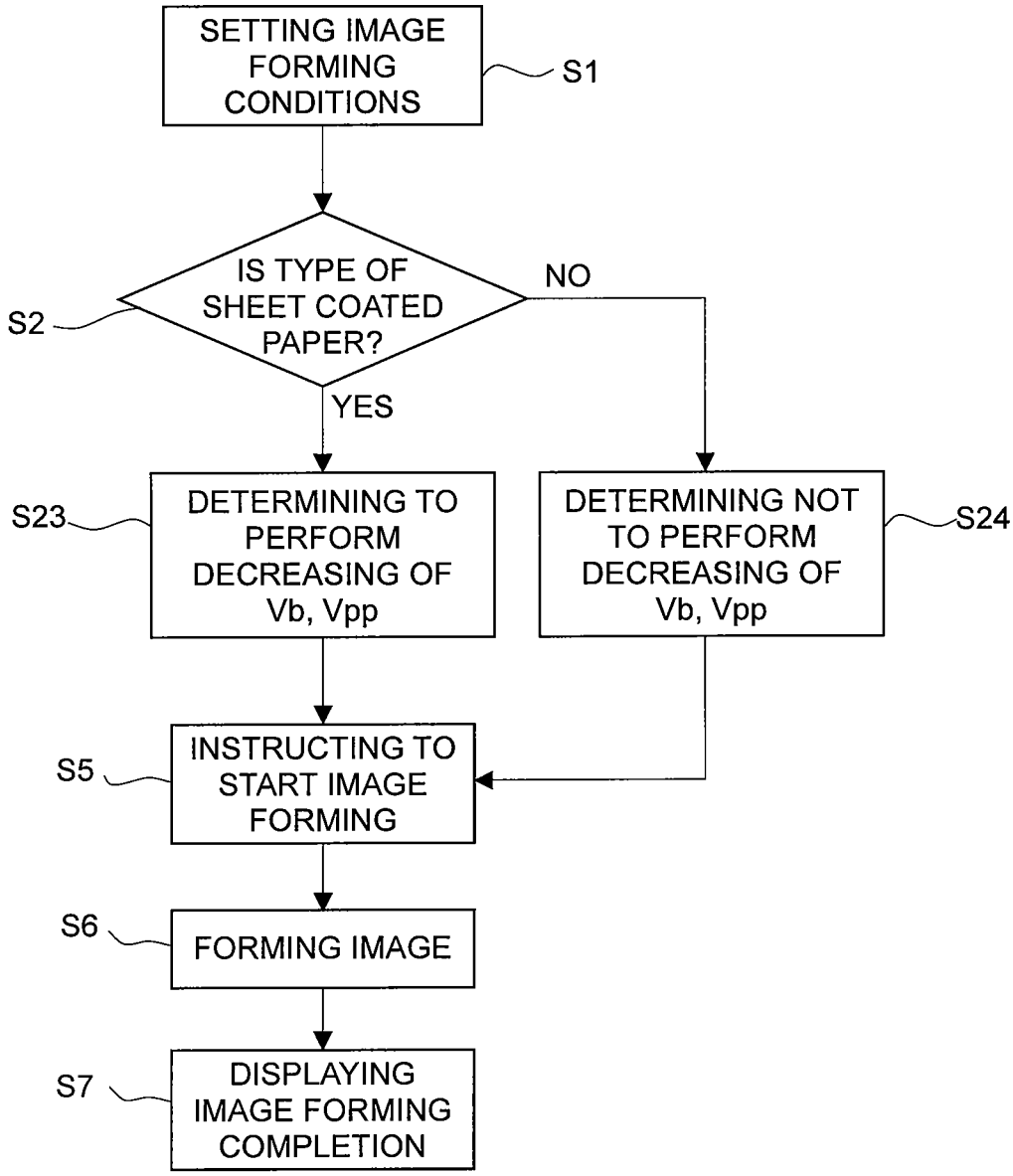
FIG. 15 is a flowchart which describes a control process of a CPU.

FIG. 15 is a flowchart which describes the control process of the CPU 11. Since the flow of S1 and S2 are similar to that of FIG. 6, the description for FIG. 6 is invoked to the description for FIG. 15. After the CPU 11 determines whether or not the type of the sheet m is coated paper (S2), in the case of "YES", the fog elimination potential difference Vb and the development bias amplitude Vpp are decreased as described above (S3). In the case of "NO", the fog elimination potential difference Vb and the development bias amplitude Vpp are not decreased (S4). Then, when the copy start button is pressed (S5), the CPU 11 performs image forming (S6) and displays completion of the image forming (S7). After the completion, the operation apparatus displays that performance of new image forming is possible.

Here, the reason why the fog and the line width WL are decreased when the development bias amplitude Vpp is decreased is as follows. When the development bias amplitude Vpp is decreased, the difference Vc between the direct current component potential Vdevdc of the developer bearing member and the potential Vi at the image portion of the photosensitive drum 1 becomes small at the period that the direct current component potential Vdevdc of the developer bearing members 41*a*, 41*b* is to be low within one cycle of the development bias (i.e., the period between time 0 and time 0.5 in FIG. 5). As a result, the toner amount adhered to the image portion of the photosensitive drum 1 is decreased.

Further, when the development bias amplitude Vpp is decreased, the difference Vc between the direct current component potential Vdevdc of the developer bearing member and the potential Vni at the non-image portion of the photosensitive drum 1 becomes small at the period that the direct current component potential Vdevdc of the developer bearing members 41*a*, 41*b* is to be high within one cycle of the development bias (i.e., the period between time 0.5 and time 1 in FIG. 5). As a result, the toner amount adhered to the non-image portion of the photosensitive drum 1 is decreased.

When the type of the sheet m is not "coated paper", the CPU 11 controls the exposure device drive portion 37 so that the fog elimination potential difference Vb is to be 150 V and controls the development bias supply 47 so that the development bias amplitude Vpp is to be 0.75 kV and the development bias wave height Vp2 is to be 1.5 kV.

Superiority of the image forming apparatus according to the second embodiment of the present invention can be seen from FIGS. 11 and 12.

Third embodiment

An image forming apparatus according to the third embodiment of the present invention has the same configuration as the image forming apparatus 100 according to the first embodiment. Hence, the same numerals are given and the description will not be repeated in an appropriate manner. The image forming apparatus according to the third embodiment is different from the image forming apparatus 100 in the following point. That is, the following point is the feature of the image forming apparatus according to the third embodiment. When the smoothness FS being "the information regarding the smoothness" is determined to be equal to or higher than the predetermined smoothness, the CPU 11 eliminates at least a part of the concavoconvex image continuing in the main scanning direction of the electrostatic image by the exposure device 3 as well as decreasing the absolute values of the fog elimination potential difference Vb and the development bias amplitude Vpp. In the image forming apparatus according to the third embodiment, the CPU 11 scans with the light beams against the photosensitive drum 1 at least either of the main scanning direction or the sub-scanning direction. Then, when the smoothness FS inputted to the operation apparatus 91 is the information indicating that the sheet m has the smoothness equal to or higher than the predetermined smoothness, the CPU 11 changes the image forming data so as to thin at least a part of the image continuing by a predetermined width at the time of forming the image continuing by the predetermined width in the axial direction of the photosensitive drum 1. In other words, when the smoothness FS is determined to be equal to or higher than the predetermined smoothness, the CPU 11 eliminates at least a part of the concavoconvex image continuing in the main scanning direction of the electrostatic image by the exposure device 3 as well as decreasing the fog elimination potential difference Vb. Here, the main scanning direction is the direction perpendicular to the paper surface of FIG. 1 and the sub-scanning direction is the circumference direction of the outside of the photosensitive drum 1 in FIG. 1.

In the following, the present embodiment will be described for copying as an example. When the type of the sheet m among the inputted image forming conditions is "coated paper", the CPU 11 controls the exposure device drive portion 37 so that the fog elimination potential difference Vb is to be 120 V (see FIG. 7). Accordingly, the ordinary fog is increased although the reversal fog is decreased (see FIG. 14). Then, since the line width WL is to be increased, the development bias supply 47 is controlled so that the development bias amplitude Vpp is to be 1 kV.

Figure 16:
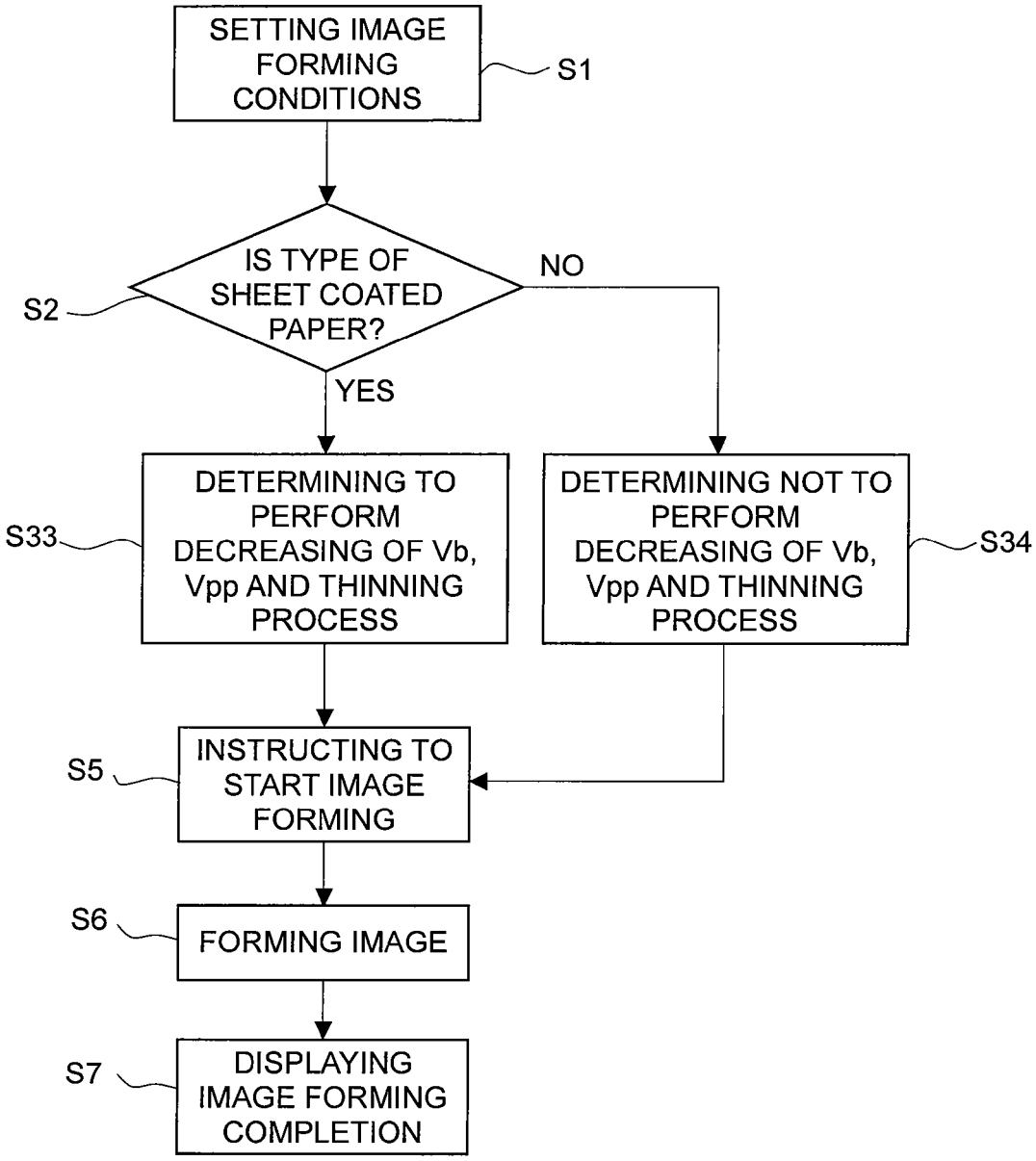
FIG. 16 is a flowchart which describes a control process of the CPU for an image forming apparatus according to a third embodiment of the present invention.

FIG. 16 is a flowchart which describes the control process of the CPU 11. By controlling the fog elimination potential difference Vb and the development bias amplitude Vpp, "the line width WL" becomes appropriate. However, there is a case that slight "tailing" and "explosion" occur. Accordingly, as illustrated in FIG. 16, in the case of "YES", the CPU 11 controls to perform a thinning process of a line image (S2, S33). In the case of "NO", the CPU 11 controls not to perform the thinning process of the line image (S2, S34). When start of image forming is instructed by pressing the copy start button (S5), the image forming is performed (S6). After the image forming is completed, the operation apparatus displays that performance of new image forming is possible (S7).

Here, "explosion" means the imaging failure of the toner being distributed to the upstream and downstream of the proper line image in the proceeding direction. Explosion is different from shadowing in the points that expansion becomes worse as the toner amount constituting the image to be outputted is increased and that expansion is integral with the image to be outputted.

Figure 17:
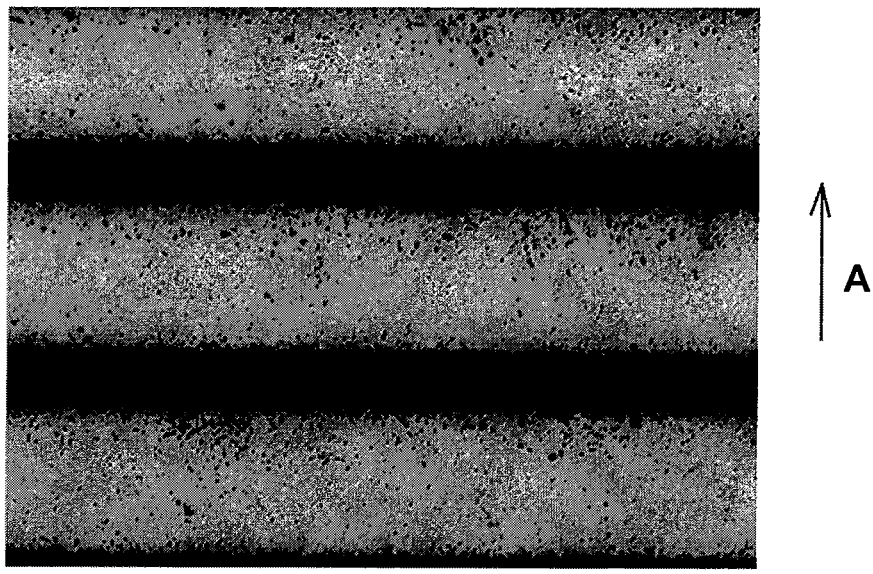
FIG. 17 is a plane view which illustrates a sheet in the state of explosion.
Figure 18:
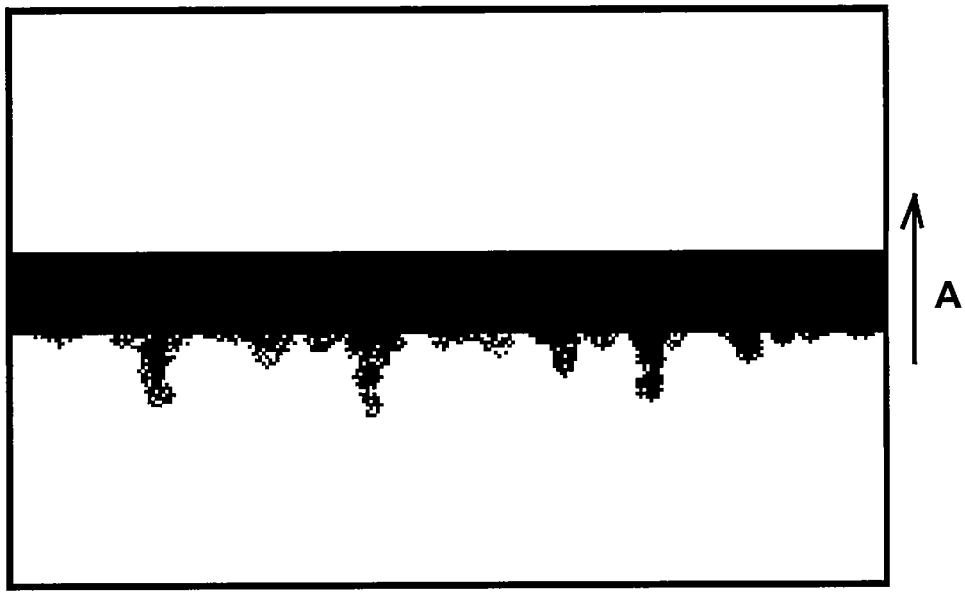
FIG. 18 is a plane view which illustrates a sheet in the state of tailing.

FIG. 17 is a plane view which illustrates the sheet m in the state of explosion. As illustrated in FIG. 17, the image explosion causes forming of patterns like a shadow at the rear side of the line image in the proceeding direction A of the sheet m. FIG. 18 is a plane view which illustrates the sheet m in the state of the tailing. As illustrated in FIG. 18, the image tailing causes forming patterns like icicles at the rear side of the line image in the proceeding direction A of the sheet m.

Here, the reason of occurrence of the tailing and the explosion is as follows. In the present embodiment, as described above, the fog elimination potential difference Vb and the development bias amplitude Vpp are decreased compared to the case that the sheet type is not "coated paper". The increase of the line width WL caused by the decrease of the fog elimination potential difference Vb is corrected by the decrease of the development bias amplitude Vpp. When the development bias amplitude Vpp is decreased as described above, the so-called edge effect (i.e., toner amount at the image periphery part is larger than that at the center portion) is worsened and the toner amount excessively adhered at the end part is increased.

Figure 19A:
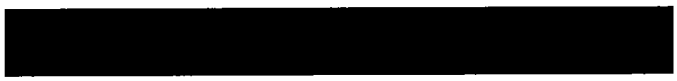
FIGS. 19A and 19B are schematic views for describing thinning.
Figure 19B:
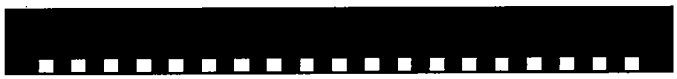

FIGS. 19A and 19B are schematic views for describing the thinning. FIG. 19A is a schematic view which illustrates a line image before being thinned. FIG. 19B is a schematic view which illustrates the line image after being thinned. The thinning process is to perform elimination as illustrated in FIG. 19B at the time of image exposure on the image having continuous part in the main scanning direction as illustrated in FIG. 19A. FIG. 19B illustrates the state strictly at the time of exposure. Since the toner is crushed and the thinned part is covered, the thinned pixels are not visualized in the output image. As the thinning process, a known method disclosed in Japanese Patent Application Laid-open No. 09-323448 can be utilized.

In the case that the type of the sheet is not "coated paper", the CPU 11 controls the exposure device drive portion 37 so that the fog elimination potential difference Vb is to be 150 V and controls the development bias supply 47 so that the development bias amplitude Vpp is to be 0.65 kV and the development bias wave height Vp2 is to be 1.3 kV. It is also different from the case that the type of the sheet m is "coated paper" in the point of not performing the thinning process (S33 and S34 in FIG. 16)

Superiority of the image forming apparatus according to the embodiment of the present invention can be seen from FIGS. 11 and 12.

Fourth Embodiment

An image forming apparatus according to the fourth embodiment of the present invention has the same configuration as the image forming apparatus 100 according to the first embodiment. Hence, the same numerals are given and the description will not be repeated in an appropriate manner. The image forming apparatus according to the fourth embodiment of the present invention is different from the image forming apparatus 100 according to the first embodiment in the point that the CPU 11 automatically acknowledges the type of the sheet m.

Figure 20:
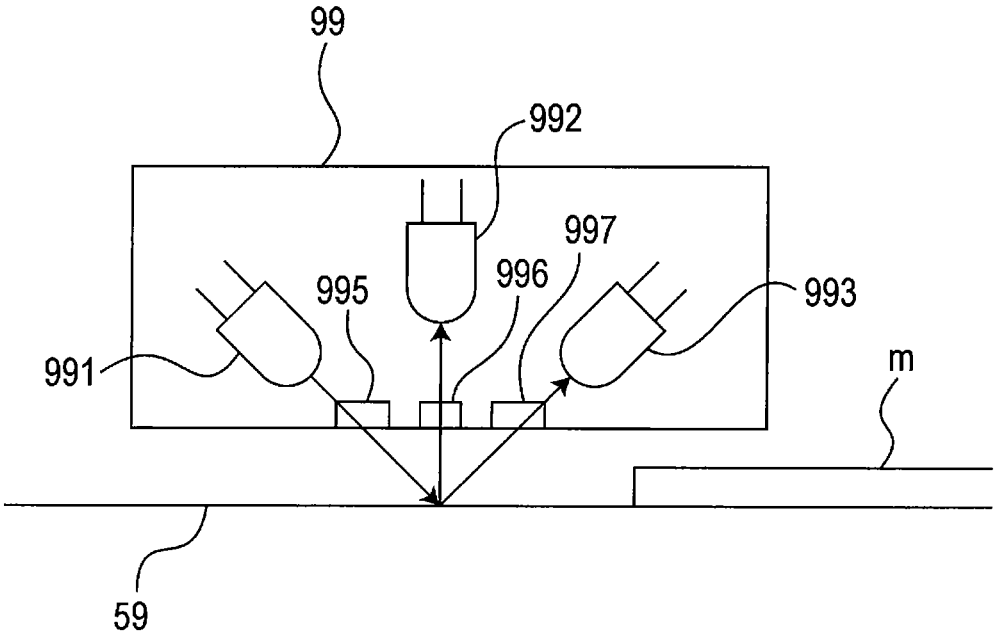
FIG. 20 is a sectional view which illustrates the configuration of a sheet type discrimination sensor for an image forming apparatus according to a fourth embodiment of the present invention.
Figure 21:
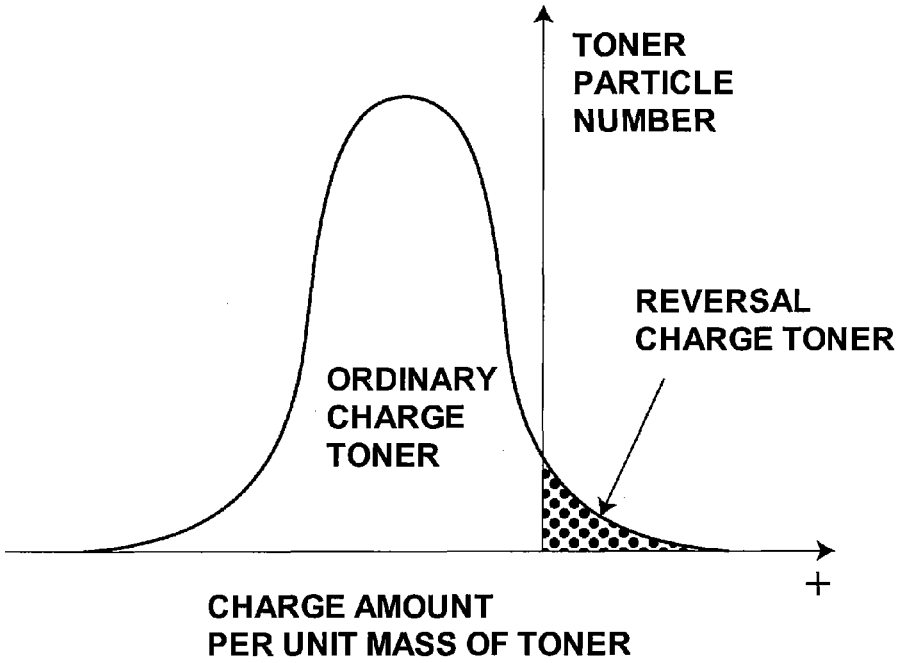
FIG. 21 is a distribution graph of electric charges of toner used for the image forming apparatus of an electrophotographic system.
Figure 22:
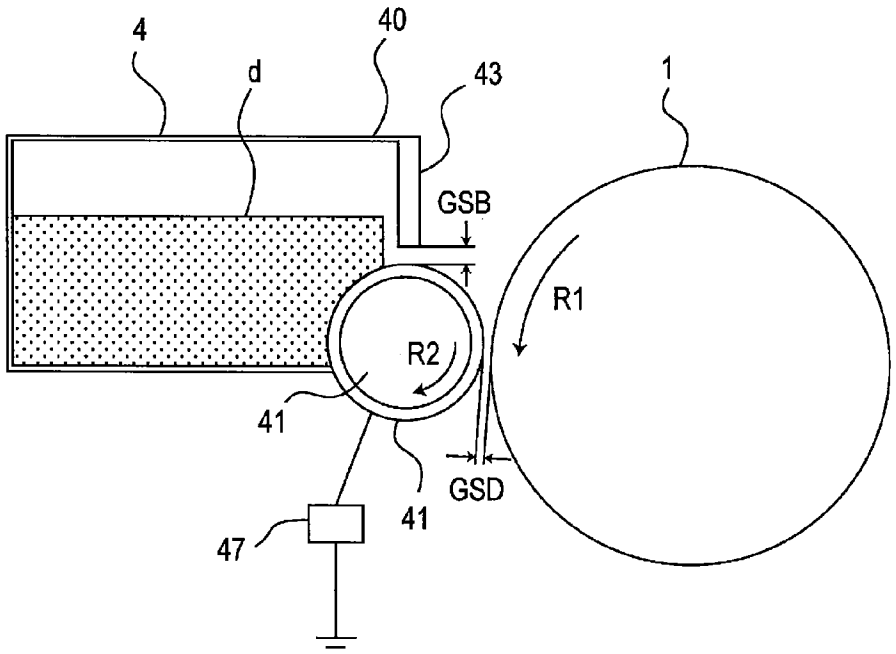
FIG. 22 is a sectional view which illustrates the configuration of a development device.
Figure 23:
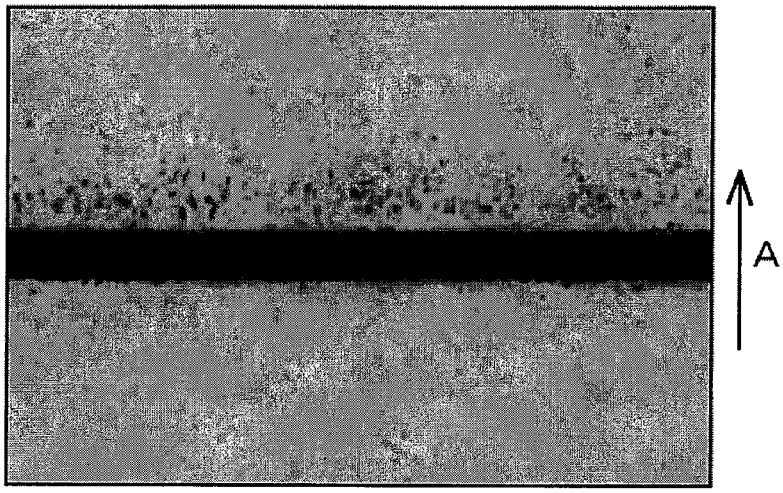
FIG. 23 is a plane view which illustrates occurrence of shadowing at a sheet surface.
Figure 24:
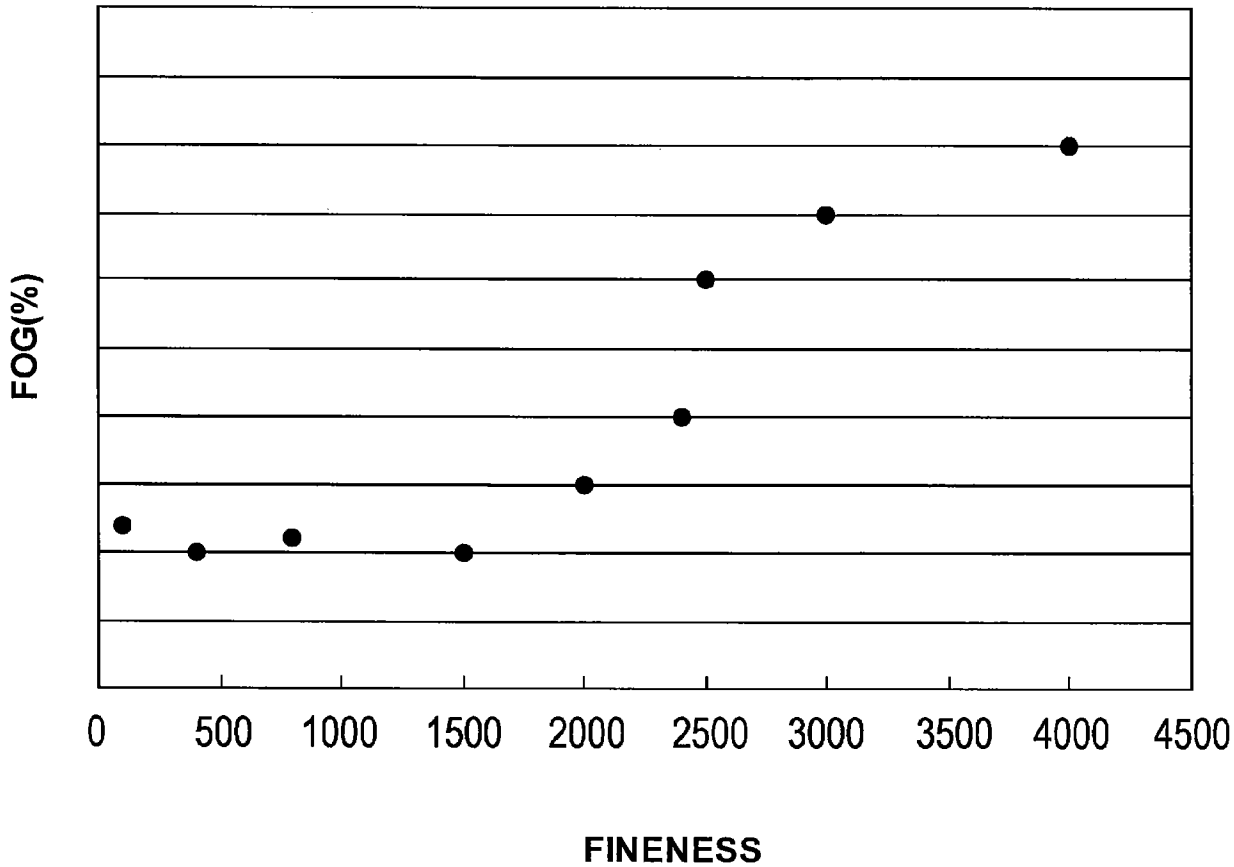
FIG. 24 is a graph which illustrates the relation between the fog and the sheet smoothness.

FIG. 20 is a sectional view which illustrates the configuration of a sheet type discrimination sensor 99. As illustrated in FIG. 20, the type of the sheet m is discriminated by the sheet type discrimination sensor 99. The sheet type discrimination sensor 99 includes a LED 991 as "first irradiation unit", a phototransistor 993 as "first reading unit" and a phototransistor 992 as "second reading unit".

Light from a light source of the LED 991 is irradiated to the surface of the sheet m on a sheet conveyance guide 59 via a slit 995. In this example, the sheet conveyance guide 59 is provided with a window through which light is irradiated from the back face side of the sheet m. Reflection light from the sheet m is collected via slits 996, 997 and received by the phototransistors 992, 993. With this configuration, glossiness of the sheet m is detected. It is known that there is a positive correlation between the glossiness and the smoothness. Therefore, in the case of exceeding a predetermined glossiness, the sheet m is determined to be coated paper.

With the image forming apparatus of the fourth embodiment, since setting the type of the sheet m is not required, amount of time required until the start of the image forming is shortened.

As described above, according to the image forming apparatus of the first to fourth embodiments, the reversal fog and shadowing are suppressed and high quality image forming is performed while maintaining high productivity without adding a special mechanism part. When performing image forming on the sheet m of high smoothness, the fog elimination potential difference Vb is decreased while maintaining the movement speed of the surface of the photosensitive drum 1 during the image forming. Thus, image outputting of high image quality can be performed even when using the sheet m of high smoothness.

With the image forming apparatus of the second and third embodiments, the development bias amplitude Vpp is decreased when the smoothness FS is equal to or higher than the predetermined smoothness. Thus, the ordinary fog and the line width variation are suppressed, so that image outputting of high quality can be performed.

With the image forming apparatus of the third embodiment, at least a part of the image continuing by the predetermined width in the axial direction of the photosensitive drum 1 being the main scanning direction of the electrostatic image by the exposure device 3 is eliminated (i.e., thinned). Thus, the tailing and explosion are suppressed, so that image outputting of high quality can be performed.

In the above, the present invention has been described with reference to specific embodiments. However, the present invention is not limited to the above-mentioned embodiments. Not limited to being drum-shaped, the photosensitive drum 1 may be belt-shaped or sheet-shaped. Further, the photosensitive layer may be formed of material having negative electrostatic property or formed of organic photosensitive material.

Further, the image exposure can be performed against the image portion (i.e., the image portion exposure method). In this case, since the toner is adhered to the image exposure portion, image exposure is not performed against the non-image portion.

Further, as the primary charging method, a brush constituted by an elastic roller, an elastic blade and charging particles may be contacted to the photosensitive drum 1.

Further, as the transfer method, it is also possible to adopt a belt transfer method that the sheet m is separated from a belt after a toner image is transferred from the photosensitive drum 1 to the sheet m which is borne on the belt. The present invention can be equally adopted to an image forming apparatus which adopts an intermediate transfer method to secondarily transfer the toner image to the sheet m from an intermediate transfer member after the toner image formed on the photosensitive drum 1 is primarily transferred once to the intermediate transfer member.

Not limited to one, the number of the photosensitive drums 1 may be two or more in the case of forming a color image and the like.

Further, not limited to one, the number of the development apparatuses corresponding to each of the photosensitive drum 1 may be two or more in the case of forming a color image and the like. Furthermore, not limited to one or two, the number of developer bearing members included to each development apparatus may be three or more in the case of performing image forming at higher speed and the like. In the present embodiment, the number of the developer bearing members is two.

Further, in the fixing apparatus, belt-shaped members can be adopted as the members to nip a sheet instead of rollers. In addition, not limited to one, the number of the fixing apparatuses may be two or more in the case of performing image forming at higher speed and the like.

In addition, naturally, the items describing specific settings such as the development bias amplitude Vpp, the frequency f, the average potential, the surface potential of the photosensitive drum 1 are appropriately arranged in accordance with use applications, use environments and the like of the image forming apparatus.

In the following, the image forming apparatus without adopting the present invention will be briefly described.

First Comparison Example

The present comparison example is different from the first embodiment only in the point that the fog elimination potential difference Vb is not changed even with the sheet m of high smoothness. As indicated in FIGS. 11 and 12, any of the shadowing, the reversal fog and the ordinary fog is not within an allowable range.

Second Comparison Example

The present comparison example is different from the first embodiment only in the point that image forming conditions are not changed at all even for the sheet m of high smoothness since discrimination of the type of the sheet m is not performed. As illustrated in FIGS. 11 and 12, any of the shadowing, the reversal fog and the ordinary fog is not within an allowable range.

Third Comparison Example

The present comparison example is different from the first embodiment only in the point of having contact pressure switching unit to switch contact pressure of the transfer member which contacts to the surface of the photosensitive drum 1. Since the contact pressure switching requires approximately 10 seconds, image forming cannot be performed during that period. As illustrated in FIGS. 11 and 12, although there is no problem with the image quality, the productivity of the image forming is considered to be extremely inferior as compared to the case without performing contact pressure switching.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-011892, filed Jan. 22, 2009, which is hereby incorporated by reference herein in its entirety.

What is claimed is:

1. An image forming apparatus comprising:

an image bearing member configured to bear a latent image;

a development apparatus which develops the latent image formed on the image bearing member with toner;

a transfer apparatus which transfers the toner image formed on the image bearing member to a transfer material;

a cleaning apparatus which contacts with the image bearing member and cleans toner remaining on the image bearing member;

an input portion to which information for smoothness of the transfer material onto which the toner image is transferred is inputted; and a controller configured to control a potential difference between a non-image portion potential of the image bearing member and a direct current component potential of a bias applied to the development apparatus at the time of forming the toner image based on the information inputted to the input portion, the controller controlling to decrease the potential difference in a case that the information inputted to the input portion is equal to or higher than a predetermined smoothness as compared to a case of being lower than the predetermined smoothness.

2. The image forming apparatus according to claim 1, wherein the controller is configured to control a development bias to decrease the amplitude of development bias applied to the development apparatus when forming the toner image in a case that the information of the transfer material inputted to the input portion is equal to or higher than a predetermined smoothness as compared to a case of being lower than the predetermined smoothness.

3. The image forming apparatus according to claim 1, wherein at least a pixel of a contiguous image area is not developed when the number of contiguous pixels exceeds a predetermined number in the axial direction of the image bearing member in a case when a smoothness of a transfer material exceeds a predetermined smoothness.

4. The image forming apparatus according to claim 1, wherein the controller decreases the potential difference by changing non-image portion potential and thereby changing the potential difference between the image portion potential and the non-image portion potential.

5. The image forming apparatus according to claim 1, wherein the development apparatus develops the latent image using single component toner.

6. The image forming apparatus according to claim 1, further comprising a corona charger which charges the image bearing member.

7. An image forming apparatus comprising:

an image bearing member configured to bear a latent image;

a development apparatus which develops the latent image formed on the image bearing member with toner;

a transfer apparatus which transfers the toner image formed on the image bearing member to a transfer material;

an input portion to which information for smoothness of the transfer material onto which the toner image is transferred is inputted; and a controller configured to control a potential difference between a non-image portion potential of the image bearing member and a direct current component potential of a bias applied to the development apparatus at the time of forming the toner image based on the information inputted to the input portion, the controller controlling to decrease the potential difference in a case that the information inputted to the input portion is equal to or higher than a predetermined smoothness as compared to a case of being lower than the predetermined smoothness, wherein the controller decreases the potential difference by changing the non-image portion potential via selective exposure of the non-image portion to a light source.

* * * * *